US012398508B2

(12) United States Patent
Okada

(10) Patent No.: US 12,398,508 B2
(45) Date of Patent: Aug. 26, 2025

(54) SYNTHETIC FIBER FIRST PROCESSING AGENT, SYNTHETIC FIBER PROCESSING AGENT, AQUEOUS SOLUTION PREPARATION METHOD, SYNTHETIC FIBER PROCESSING METHOD, SYNTHETIC FIBERS, SHORT FIBERS, SPUN YARD AND NON-WOVEN FABRIC

(71) Applicant: TAKEMOTO YUSHI KABUSHIKI KAISHA, Gamagori (JP)

(72) Inventor: Tomoya Okada, Gamagori (JP)

(73) Assignee: TAKEMOTO YUSHI KABUSHIKI KAISHA, Gamagori (JP)

( * ) Notice: Subject to any disclaimer, the term of this patent is extended or adjusted under 35 U.S.C. 154(b) by 0 days.

(21) Appl. No.: 18/043,223

(22) PCT Filed: Dec. 22, 2021

(86) PCT No.: PCT/JP2021/047472
§ 371 (c)(1),
(2) Date: Feb. 27, 2023

(87) PCT Pub. No.: WO2022/138688
PCT Pub. Date: Jun. 30, 2022

(65) Prior Publication Data

US 2023/0366143 A1 Nov. 16, 2023

(30) Foreign Application Priority Data

Dec. 25, 2020 (JP) ..... 2020-217448

(51) Int. Cl.

| | |
|---|---|
| ***D06M 13/292*** | (2006.01) |
| ***D06M 13/144*** | (2006.01) |
| ***D06M 15/53*** | (2006.01) |
| ***D06M 101/20*** | (2006.01) |
| ***D06M 101/32*** | (2006.01) |

(52) U.S. Cl.
CPC ..... *D06M 13/292* (2013.01); *D06M 13/144* (2013.01); *D06M 15/53* (2013.01); *D06M 2101/20* (2013.01); *D06M 2101/32* (2013.01); *D06M 2200/00* (2013.01)

(58) Field of Classification Search
CPC .. D06M 13/292; D06M 13/144; D06M 15/53; D06M 2101/20; D06M 2101/32; D06M 2200/00
USPC ..... 442/114
See application file for complete search history.

(56) References Cited

FOREIGN PATENT DOCUMENTS

| | | | | |
|---|---|---|---|---|
| JP | 2006274515 A1 | | 10/2006 | |
| JP | 2016223035 A | | 12/2016 | |
| JP | 2017025438 A | | 2/2017 | |
| JP | 6777347 | | 10/2020 | |
| JP | 6777347 B1 | * | 10/2020 | ..... D06M 13/224 |
| JP | 6777348 | | 10/2020 | |
| JP | 6777349 | | 10/2020 | |
| JP | 6777349 B1 | * | 10/2020 | |

OTHER PUBLICATIONS

International Search Report for Application No. PCT/JP2021/047472 mailed Mar. 1, 2022.

* cited by examiner

*Primary Examiner* — Camie S Thompson
(74) *Attorney, Agent, or Firm* — CANTOR COLBURN LLP

(57) ABSTRACT

The present invention addresses the problem of providing a synthetic fiber first processing agent which improves storage stability. This synthetic fiber first processing agent contains a phosphate compound (A), a solvent (S) and an optional non-ionic surfactant (C), said agent being characterized in that the content ratio of the phosphate compound (A) to the non-ionic surfactant (C) is within a prescribed range, and by being used in conjunction with a synthetic fiber second processing agent which contains a non-ionic surfactant (E). The phosphate compound (A) contains a prescribed organic phosphate ester compound, and the proton NMR integration ratio attributable to an inorganic phosphate compound during proton NMR measurement when performing an alkali over-neutralization preprocessing is set to a prescribed range. The solvent (S) has a boiling point no higher than 105° C. at atmospheric pressure. The non-ionic surfactant (C) has a (poly)oxyalkylene structure in the molecule thereof.

22 Claims, No Drawings

SYNTHETIC FIBER FIRST PROCESSING AGENT, SYNTHETIC FIBER PROCESSING AGENT, AQUEOUS SOLUTION PREPARATION METHOD, SYNTHETIC FIBER PROCESSING METHOD, SYNTHETIC FIBERS, SHORT FIBERS, SPUN YARD AND NON-WOVEN FABRIC

TECHNICAL FIELD

The present invention relates to a first synthetic fiber treatment agent that contains a phosphate compound and to a synthetic fiber treatment agent, a method for preparing an aqueous liquid, a method for treating a synthetic fiber, a synthetic fiber, a short fiber, a spun yarn, and a nonwoven fabric that use the first synthetic fiber treatment agent.

BACKGROUND ART

Generally, a treatment of adhering a synthetic fiber treatment agent to the surface of a synthetic fiber is performed at times from standpoints of, for example, reducing friction and improving antistatic property in a fiber spinning and stretching process and a finishing process of the synthetic fiber.

Patent Document 1 discloses a known synthetic fiber treatment agent. The synthetic fiber treatment agent contains a specific alkyl phosphate ester, a surfactant such as a polyoxyalkylene alkyl ether, and a monohydric aliphatic alcohol having an alkyl group with 12 to 22 carbon atoms in the molecule.

PRIOR ART LITERATURE

Patent Literature

Patent Document 1: Japanese National Phase Laid-Open Patent Publication No. 2016-223035

SUMMARY OF THE INVENTION

Problems that the Invention is to Solve

Further improvement of the storage stability of a synthetic fiber treatment agent is being demanded.

Means for Solving the Problems

As a result of performing research toward solving the above problem, the inventor of the present application found that, in a synthetic fiber treatment agent, an arrangement that is divided into a first synthetic fiber treatment agent that contains a specific phosphate compound and a second synthetic fiber treatment agent that contains a surfactant is favorable.

To solve the above problem and in accordance with one aspect of the present invention, a first synthetic fiber treatment agent is provided that contains a phosphate compound (A), a solvent (S), and optionally a nonionic surfactant (C). The treatment agent has a mass ratio of the content of the phosphate compound (A) and the content of the nonionic surfactant (C) such that phosphate compound (A)/nonionic surfactant (C) is 95/5 to 100/0. The treatment agent is used in combination with a second synthetic fiber treatment agent that contains a nonionic surfactant (E).

The phosphate compound (A) contains as organic phosphate ester compounds a phosphate ester P1 represented by Formula (1) shown below, a phosphate ester P2 represented by Formula (2) shown below, and optionally a phosphate ester P3 represented by Formula (3) shown below. When in a P nucleus NMR measurement made upon performing an alkali over neutralization pretreatment, the total of P nucleus NMR integral ratios attributed to the phosphate ester P1, the phosphate ester P2, the phosphate ester P3, and an inorganic phosphate compound is taken as 100%, the P nucleus NMR integral ratio attributed to the inorganic phosphate compound is more than 0% but not more than 20%.

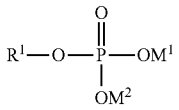

(1)

In Formula (1), $R^1$ is an alkyl group or an alkenyl group with 15 to 20 carbon atoms and $M^1$ and $M^2$ are each a hydrogen atom or potassium.

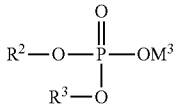

(2)

In Formula (2), $R^2$ and $R^3$ are each an alkyl group or an alkenyl group with 15 to 20 carbon atoms and $M^3$ is a hydrogen atom or potassium.

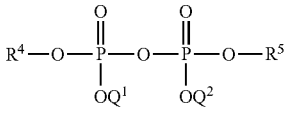

(3)

In Formula (3), $R^4$ and $R^5$ are each an alkyl group or an alkenyl group with 15 to 20 carbon atoms and $Q^1$ and $Q^2$ are each a hydrogen atom or potassium.

The solvent (S) has a boiling point at atmospheric pressure of not more than 105° C.

The nonionic surfactant (C) has a (poly)oxyalkylene structure in the molecule.

Preferably with the first synthetic fiber treatment agent, the second synthetic fiber treatment agent optionally contains an organic phosphate ester compound (D) and has a content of the organic phosphate ester compound (D) of not more than 5% by mass.

Preferably with the first synthetic fiber treatment agent, when the total of P nucleus NMR integral ratios attributed to the phosphate ester P1, the phosphate ester P2, and the phosphate ester P3 is taken as 100%, the P nucleus NMR integral ratio attributed to the phosphate ester P1 is not less than 20% and not more than 90%, the P nucleus NMR integral ratio attributed to the phosphate ester P2 is not less than 10% and not more than 70%, and the P nucleus NMR integral ratio attributed to the phosphate ester P3 is not more than 40%.

Preferably with the first synthetic fiber treatment agent, the P nucleus NMR integral ratio attributed to the inorganic phosphate compound is more than 0% but not more than 10%.

Preferably with the first synthetic fiber treatment agent, the solvent (S) is water.

Preferably, the first synthetic fiber treatment agent further contains a monohydric aliphatic alcohol (B) with 8 to 20 carbon atoms and the content of the monohydric aliphatic alcohol (B) in nonvolatile matter of the first synthetic fiber treatment agent is more than 0.1% by mass but not more than 15% by mass.

Preferably, the first synthetic fiber treatment agent has an acid value of not less than 0 mg KOH/g and not more than 20 mg KOH/g.

Preferably, the first synthetic fiber treatment agent has a viscosity at 30° C. of not more than 40,000 mPa·s.

Preferably, the first synthetic fiber treatment agent has a nonvolatile concentration of not less than 20% by mass and not more than 60% by mass.

Preferably, the first synthetic fiber treatment agent has a sodium ion concentration of more than 0 ppm but not more than 10,000 ppm, a calcium ion concentration of more than 0 ppm but not more than 200 ppm, and a magnesium ion concentration of more than 0 ppm but not more than 150 ppm as detected from nonvolatile matter of the first synthetic fiber treatment agent by an ICP emission spectroscopy method.

Preferably, the first synthetic fiber treatment agent is applied to a short fiber.

Preferably, the first synthetic fiber treatment agent is applied to a polyester or a polyolefin.

Preferably, the first synthetic fiber treatment agent is applied to a polyester.

To solve the above problem and in accordance with another aspect of the present invention, a synthetic fiber treatment agent is provided that contains the first synthetic fiber treatment agent and a second synthetic fiber treatment agent that contains a nonionic surfactant (E).

With the synthetic fiber treatment agent, the second synthetic fiber treatment agent may further optionally contain not more than 5% by mass of an organic phosphate ester compound (D).

To solve the above problem and in accordance with another aspect of the present invention, a method for preparing an aqueous liquid of a synthetic fiber treatment agent is provided that includes adding to water the first synthetic fiber treatment agent and a second synthetic fiber treatment agent that contains a nonionic surfactant (E) to prepare the aqueous liquid with a nonvolatile concentration of not less than 0.01% by mass and not more than 10% by mass.

In the method for preparing an aqueous liquid of a synthetic fiber treatment agent, said adding may include a first step of adding the first synthetic fiber treatment agent and the second synthetic fiber treatment agent to a first water to prepare an aqueous liquid of a synthetic fiber treatment agent with a nonvolatile concentration of more than 2% by mass but not more than 10% by mass and a second step of adding a second water to the aqueous liquid of the synthetic fiber treatment agent prepared in the first step to prepare an aqueous liquid of a synthetic fiber treatment agent with a nonvolatile concentration of not less than 0.01% by mass and not more than 10% by mass.

Preferably with the method for preparing an aqueous liquid of a synthetic fiber treatment agent, the first step includes adding the first synthetic fiber treatment agent and the second synthetic fiber treatment agent to water of 60° C. to 95° C. that is of 20% to 70% by mass of the total amount of the first water and thereafter adding the remaining first water of not more than 40° C.

Preferably with the method for preparing an aqueous liquid of a synthetic fiber treatment agent, the first step includes adding the first synthetic fiber treatment agent to water of 60° C. to 95° C. that is of 20% to 70% by mass of the total amount of the first water, thereafter further adding the remaining first water of not more than 40° C., and thereafter further adding the second synthetic fiber treatment agent.

To solve the above problem and in accordance with another aspect of the present invention, a method for treating a synthetic fiber is provided that includes imparting to a synthetic fiber an aqueous liquid of a synthetic fiber treatment agent obtained by adding to water the first synthetic fiber treatment agent and a second synthetic fiber treatment agent that contains a nonionic surfactant (E).

To solve the above problem and in accordance with another aspect of the present invention, a synthetic fiber is provided to which the first synthetic fiber treatment agent and a second synthetic fiber treatment agent that contains a nonionic surfactant (E) are adhered.

To solve the above problem and in accordance with another aspect of the present invention, a short fiber is provided to which the first synthetic fiber treatment agent and a second synthetic fiber treatment agent that contains a nonionic surfactant (E) are adhered.

To solve the above problem and in accordance with another aspect of the present invention, a spun yarn is provided to which the first synthetic fiber treatment agent and a second synthetic fiber treatment agent that contains a nonionic surfactant (E) are adhered.

To solve the above problem and in accordance with another aspect of the present invention, a nonwoven fabric is provided to which the first synthetic fiber treatment agent and a second synthetic fiber treatment agent that contains a nonionic surfactant (E) are adhered.

Effects of the Invention

The present invention succeeds in improving the storage stability of a treatment agent.

MODES FOR CARRYING OUT THE INVENTION

First Embodiment

A first embodiment that embodies a first synthetic fiber treatment agent according to the present invention (hereinafter referred to as the first treatment agent) will now be described. The first treatment agent of the present embodiment contains a phosphate compound (A) that is described below and a solvent (S) that is described below. A nonionic surfactant (C) to be described later may also be contained optionally.

(Phosphate Compound (A))

The phosphate compound (A) contains as organic phosphate ester compounds a phosphate ester P1 represented by Formula (1) shown below, a phosphate ester P2 represented by Formula (2) shown below, and optionally a phosphate ester P3 represented by Formula (3) shown below. When applied to a synthetic fiber, the phosphate compound (A) improves antistatic property and reduces friction.

(1)

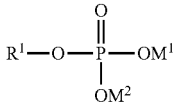

In Formula (1), $R^1$ is an alkyl group or an alkenyl group with 15 to 20 carbon atoms and $M^1$ and $M^2$ are each a hydrogen atom or potassium.

(2)

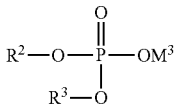

In Formula (2), $R^2$ and $R^3$ are each an alkyl group or an alkenyl group with 15 to 20 carbon atoms and $M^3$ is a hydrogen atom or potassium.

(3)

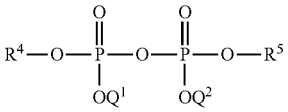

In Formula (3), $R^4$ and $R^5$ are each an alkyl group or an alkenyl group with 15 to 20 carbon atoms and $Q^1$ and $Q^2$ are each a hydrogen atom or potassium.

With each of the phosphate esters P1 to P3, one type of phosphate ester may be used alone or two or more types of phosphate ester may be used in combination as appropriate.

An alkyl group that constitutes each of $R^1$ to $R^5$ may be a straight chain alkyl group or may be an alkyl group having a branched chain structure. As an alkyl group having a branched chain structure, either of an alkyl group that is branched at the 3 position and a multiply branched alkyl group can be adopted.

Specific examples of a straight chain alkyl group that constitutes each of $R^1$ to $R^5$ include a pentadecyl group, a hexadecyl group, a heptadecyl group, an octadecyl group, a nonadecyl group, and an icosyl group. Specific examples of an alkyl group having a branched chain structure that constitutes each of $R^1$ to $R^5$ include an isopentadecyl group, an isohexadecyl group, an isoheptadecyl group, an isooctadecyl group, an isononadecyl group, and an isoicosyl group.

A straight chain alkyl group that constitutes each of $R^1$ to $R^5$ is preferably a hexadecyl group or an octadecyl group and more preferably an octadecyl group in consideration of the processability in a carding process, a drawing process, and a fine spinning process of spun yarn manufacturing or the processability in a carding process of nonwoven fabric manufacturing.

An alkenyl group that constitutes each of $R^1$ to $R^5$ may be a straight chain alkenyl group or may be an alkenyl group having a branched chain structure. As an alkenyl group having a branched chain structure, either of an alkenyl group that is branched at the β position and a multiply branched alkenyl group can be adopted.

Specific examples of a straight chain alkenyl group that constitutes each of $R^1$ to $R^5$ include a pentadecenyl group, a hexadecenyl group, a heptadecenyl group, an octadecenyl group, a nonadecenyl group, and an icosenyl group.

Specific examples of an alkenyl group having a branched chain structure that constitutes each of $R^1$ to $R^5$ include an isopentadecenyl group, an isohexadecenyl group, an isoheptadecenyl group, an isooctadecenyl group, an isononadecenyl group, and an isoicosenyl group.

With the phosphate compound (A), when in a P nucleus NMR measurement made upon performing an alkali over neutralization pretreatment, the total of P nucleus NMR integral ratios attributed to the phosphate ester P1, the phosphate ester P2, the phosphate ester P3, and an inorganic phosphate compound is taken as 100%, the P nucleus NMR integral ratio attributed to the inorganic phosphate compound is more than 0% but not more than 20% and preferably more than 0% but not more than 10%. When the P nucleus NMR integral ratio attributed to the inorganic phosphate compound is more than 0%, the handling property of the first treatment agent is improved. When the P nucleus NMR integral ratio attributed to the inorganic phosphate compound is not more than 20%, the stability of the first treatment agent is improved. The P nucleus NMR integral ratio attributed to the inorganic phosphate compound is expressed by Numerical Formula (1) shown below:

[Numerical Formula 1]

$$\text{Phosphate_P (\%)}=\{\text{Phosphate_P}/(\text{P1_P}+\text{P2_P}+\text{P3_P}+\text{Phosphate_P})\}\times 100 \quad (1)$$

In Numerical Formula (1),

Phosphate_P (%) of the left side represents the P nucleus NMR integral ratio attributed to the inorganic phosphate compound, P1_P represents a P nucleus NMR integral value attributed to the phosphate ester P1, P2_P represents a P nucleus NMR integral value attributed to the phosphate ester P2, and P3_P represents the P nucleus NMR integral value attributed to the phosphate ester P3, and Phosphate_P of the right side represents a P nucleus NMR integral value attributed to the inorganic phosphate compound.

The above-mentioned "alkali over neutralization pretreatment" refers to a pretreatment of adding an excess amount of potassium hydroxide with respect to the phosphate compound.

By performing this "alkali over neutralization pretreatment" in making a $^{31}$P-NMR measurement, peaks attributed to the phosphate ester P1, the phosphate ester P2, the phosphate ester P3, and the inorganic phosphate compound can be separated clearly. It becomes possible to perform calculation of the P nuclear NMR integral ratios attributed to the respective compounds by Numerical Formula (1). Inorganic phosphate compounds include free phosphoric acid not in salt form and potassium dihydrogen phosphate, dipotassium hydrogen phosphate, and tripotassium phosphate as salts of phosphoric acid. By the alkali over neutralization pretreatment, the inorganic phosphate compounds contained in the phosphate compound (A) are all converted to tripotassium phosphate. Also, for the $^{31}$P-NMR measurements for the Examples section to be described later, the alkali over neutralization pretreatment was performed in which the alkali of a level at which observed peaks are separated is added to the phosphate compound.

The phosphate compound (A) is preferably such that when the total of P nucleus NMR integral ratios attributed to the phosphate ester P1, the phosphate ester P2, and the phosphate ester P3 is taken as 100%, the P nucleus NMR integral ratio attributed to the phosphate ester P1 is not less than 20% and not more than 90%, the P nucleus NMR integral ratio attributed to the phosphate ester P2 is not less than 10% and not more than 70%, and the P nucleus NMR integral ratio attributed to the phosphate ester P3 is not more than 40%. By being specified in such ranges, the advantageous effects of the present invention are improved further.

The P nucleus NMR integral ratio attributed to the phosphate ester P1 is expressed by Numerical Formula (2) shown below, the P nucleus NMR integral ratio attributed to the phosphate ester P2 is expressed by Numerical Formula (3) shown below, and the P nucleus NMR integral ratio attributed to the phosphate ester P3 is expressed by Numerical Formula (4) shown below:

[Numerical Formula 2]

$$P1_P\ (\%)=\{P1_P/(P1_P+P2_P+P3_P)\}\times 100 \quad (2)$$

In Numerical Formula (2),

P1_P (%) of the left side represents the P nucleus NMR integral ratio attributed to the phosphate ester P1, P1_P of the right side represents the P nucleus NMR integral value attributed to the phosphate ester P1, P2_P represents the P nucleus NMR integral value attributed to the phosphate ester P2, and P3_P represents the P nucleus NMR integral value attributed to the phosphate ester P3.

[Numerical Formula 3]

$$P2_P\ (\%)=\{P1_P/(P2_P+P2_P+P3_P)\}\times 100 \quad (3)$$

In Numerical Formula (3),

P2_P (%) of the left side represents the P nucleus NMR integral ratio attributed to the phosphate ester P2, P1_P represents the P nucleus NMR integral value attributed to the phosphate ester P1, P2_P of the right side represents the P nucleus NMR integral value attributed to the phosphate ester P2, and P3_P represents the P nucleus NMR integral value attributed to the phosphate ester P3.

[Numerical Formula 4]

$$P3_P\ (\%)=\{P3_P/(P1_P+P2_P+P3_P)\}\times 100 \quad (4)$$

In Numerical Formula (4),

P3_P (%) of the left side represents the P nucleus NMR integral ratio attributed to the phosphate ester P3, P1_P represents the P nucleus NMR integral value attributed to the phosphate ester P1, P2_P represents the P nucleus NMR integral value attributed to the phosphate ester P2, and P3_P of the right side represents the P nucleus NMR integral value attributed to the phosphate ester P3.

The phosphate compound (A) is synthesized by making an aliphatic alcohol with 15 to 20 carbon atoms as a raw material react with, for example, diphosphorus pentoxide to obtain a phosphate ester and thereafter neutralizing or over neutralizing the phosphate ester with an alkali, such as potassium hydroxide, as necessary. With the above-mentioned synthesis method, the phosphate ester compound normally becomes a mixture of the phosphate ester P1, the phosphate ester P2, the phosphate ester P3, and phosphoric acid or a salt of phosphoric acid that is the inorganic phosphate compound. Preparation may be performed by mixing the phosphate ester P1, the phosphate ester P2, the phosphate ester P3, and the inorganic phosphate compound that have been synthesized respectively.

(Solvent (S))

The solvent (S) has a boiling point at atmospheric pressure of not more than 105° C. Specific examples of the solvent (S) include water and an organic solvent. Specific examples of an organic solvent include ethanol, propanol, and other lower alcohols and hexane and other low polarity solvents. With these solvents (S), one type of solvent may be used alone or two or more types of solvent may be used in combination as appropriate. Among these, a polar solvent, such as water or a lower alcohol, is preferable from a standpoint of making a mixture in which the first treatment agent and a second synthetic fiber treatment agent (hereinafter referred to as the "second treatment agent") are mixed be of emulsion form, and water is more preferable from a standpoint of being excellent in handleability.

The content of the solvent (S) in the first treatment agent is set as appropriate from standpoints of type, handleability, stability, etc., of the solvent. The lower limit of the content of the solvent (S) in the first treatment agent is preferably not less than 40% by mass and more preferably not less than 50% by mass. The upper limit of the content of the solvent (S) in the first treatment agent is preferably not more than 80% by mass and more preferably not more than 70% by mass.

(Nonionic Surfactant (C))

The nonionic surfactant (C) has a (poly)oxyalkylene structure in the molecule. Examples of the nonionic surfactant (C) include an alkylene oxide adduct of an alcohol or a carboxylic acid, an ether ester compound in which an alkylene oxide is added to an ester compound of a carboxylic acid and a polyhydric alcohol, an alkylene oxide adduct of an amine compound such as an alkylamine. With these nonionic surfactant (C), one type of nonionic surfactant may be used alone or two or more types of nonionic surfactant may be used in combination as appropriate.

Specific examples of an alcohol used as a raw material of the nonionic surfactant include (1) straight-chain alkyl alcohols, such as methanol, ethanol, propanol, butanol, pentanol, hexanol, octanol, nonanol, decanol, undecanol, dodecanol, tridecanol, tetradecanol, pentadecanol, hexadecanol, heptadecanol, octadecanol, nonadecanol, eicosanol, heneicosanol, docosanol, tricosanol, tetracosanol, pentacosanol, hexacosanol, heptacosanol, octacosanol, nonacosanol, and triacontanol, (2) branched alkyl alcohols, such as isobutanol, isohexanol, 2-ethylhexanol, isononanol, isodecanol, isododecanol, isotridecanol, isotetradecanol, isopentadecanol, isohexadecanol, isoheptadecanol, isooctadecanol, isononadecanol, isoeicosanol, isoheneicosanol, isodocosanol, isotricosanol, isotetracosanol, isopentacosanol, isohexacosanol, isoheptacosanol, isooctacosanol, isononacosanol, and isotriacontanol, (3) straight-chain alkenyl alcohols, such as tetradecenol, hexadecenol, heptadecenol, octadecenol, and nonadecenol, (4) branched alkenyl alcohols, such as isohexadecenol and isooctadecenol, (5) cyclic alkyl alcohols, such as cyclopentanol and cyclohexanol, and (6) aromatic alcohols, such as phenol, nonylphenol, benzyl alcohol, monostyrenated phenol, distyrenated phenol, and tristyrenated phenol.

Specific examples of a carboxylic acid used as a raw material of the nonionic surfactant include (1) straight-chain alkyl carboxylic acids, such as octylic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, and docosanoic acid, (2) branched alkyl carboxylic acids, such as 2-ethylhexanoic acid, isododecanoic acid, isotridecanoic acid, isotetradecanoic acid, isohexadecanoic acid, and isooctadecanoic acid, (3) straight-chain alkenyl carboxylic acids, such as octadecenoic acid, octadecadienoic acid, and octadecatrienoic acid, and (4) aromatic based carboxylic acid, such as benzoic acid.

Specific examples of an alkylene oxide used as a raw material of the nonionic surfactant include ethylene oxide and propylene oxide. The number of moles of alkylene oxide added is set as appropriate and is preferably 0.1 to 60 moles, more preferably 1 to 40 moles, and even more preferably 2 to 30 moles. Here, the number of moles of alkylene oxide added represents the number of moles of the alkylene oxide with respect to 1 mole of the alcohol or the carboxylic acid in charged raw materials. If a plurality of types of alkylene oxide are used, those may be arranged as a block adduct or a random adduct.

Specific examples of a polyhydric alcohol used as a raw material of the nonionic surfactant include ethylene glycol, propylene glycol, 1,3-propanediol, 1,2-butanediol, 1,3-butanediol, 1,4-butanediol, 2-methyl-1,2-propanediol, 1,5-pentanediol, 1,6-hexanediol, 2,5-hexanediol, 2-methyl-2,4-pentanediol, 2,3-dimethyl-2,3-butanediol, glycerin, 2-methyl-2-hydroxymethyl-1,3-propanediol, 2-ethyl-2-hydroxymethyl-1,3-propanediol, trimethylolpropane, sorbitan, pentaerythritol, and sorbitol.

Specific examples of an alkylamine used as a raw material of the nonionic surfactant include methylamine, ethylamine, butylamine, octylamine, laurylamine, octadecylamine, and palm amine.

Specific examples of the nonionic surfactant (C) include polyoxyethylene alkyl ethers, polyoxyethylene alkenyl ethers, polyoxyethylene polyoxypropylene alkyl ethers (block adducts, random adducts), polyoxyethylene polyoxypropylene alkenyl ethers (block adducts, random adducts), polyoxypropylene alkyl ethers, polyoxypropylene alkenyl ethers, polyoxyethylene adducts of oils and fats, polyoxyethylene polyoxypropylene adducts of oils and fats (random adducts, block adducts), polyoxyethylene fatty acid esters, polyoxyethylene polyoxypropylene fatty acid esters (random adducts, block adducts), polyoxyethylene alkyl amine ethers, acid neutralization products of polyoxyethylene alkyl amine ethers, polyoxyethylene polyhydric alcohol ether fatty acid esters, and polyoxyethylene polyoxypropylene polyhydric alcohol ether fatty acid esters (random adducts, block adducts).

The upper limit of the content of the nonionic surfactant (C) in the first treatment agent is preferably not more than 5% by mass, more preferably not more than 2% by mass, and even more preferably not more than 1% by mass. By specifying the content to be not more than 5% by mass, the stability of the first treatment agent is improved further.

The first treatment agent has a mass ratio of the content of the phosphate compound (A) and the content of the nonionic surfactant (C) such that phosphate compound (A)/nonionic surfactant (C) is 95/5 to 100/0, preferably 98/2 to 100/0, and more preferably 99/1 to 100/0. By being specified in such range, the stability of the first treatment agent is improved.

(Monohydric Aliphatic Alcohol (B))

The first treatment agent may further contain a monohydric aliphatic alcohol (B) with 8 to 20 carbon atoms. By blending the monohydric aliphatic alcohol (B), the stability of the first treatment agent is improved further. The monohydric aliphatic alcohol (B) is not particularly limited whether or not having an unsaturated bond and may be an alcohol having a straight chain or branched chain hydrocarbon group.

Specific examples of the monohydric aliphatic alcohol (B) include stearyl alcohol, oleyl alcohol, cetyl alcohol, lauryl alcohol, octyl alcohol, and isostearyl alcohol. With the monohydric aliphatic alcohol (B), one type of monohydric aliphatic alcohol may be used alone or two or more types of monohydric aliphatic alcohol may be used in combination as appropriate.

The lower limit of the content of the monohydric aliphatic alcohol (B) in nonvolatile matter of the first treatment agent is preferably more than 0.1% by mass and more preferably not less than 1% by mass. When more than 0.1% by mass, the stability of the first treatment agent is improved further. The upper limit of the content of the monohydric aliphatic alcohol (B) in nonvolatile matter of the first treatment agent is preferably not more than 15% by mass and more preferably not more than 10% by mass. When not more than 15% by mass, the stability of the first treatment agent is improved by suppressing separation and also, the handling property of the first treatment agent is improved by suppressing increase in viscosity.

Here, the nonvolatile matter refers to absolute dry matter obtained by heat treating 1 g of the first treatment agent at 105° C. for 2 hours to sufficiently remove a volatile diluent. Hereinafter, the same conditions shall be adopted for the definition of nonvolatile matter.

(Others)

In accordance with an application purpose or necessity and within ranges in which the effects of the present invention are not impaired, the first treatment agent may further contain another component (F), for example, a polyhydric alcohol; a mineral oil, an ester, or a silicone compound as a smoothing agent; an anionic surfactant; or a chelating agent. Specific examples of a polyhydric alcohol include propylene glycol, diethylene glycol, ethylene glycol, and glycerin. When a trihydric or higher alcohol is contained, the stability of the first treatment agent at high temperature deteriorates. Therefore, the amount of a trihydric or higher alcohol contained in the first treatment agent is preferably not more than 5% by mass %, and more preferably the first treatment agent does not contain trihydric or higher alcohols. The deterioration of the stability of the first treatment agent at high temperature is due to occurrence of increase in viscosity with elapsed time. This is considered to be due to a trihydric or higher alcohol being high in viscosity in itself and additionally due to three or more polar groups contributing to formation of multidimensional hydrogen bonds.

Specific examples of a mineral oil include paraffin wax and hydrotreated light paraffin. Specific examples of an ester include sorbitan monooleate, sorbitan monostearate, glycerin monooleate, and castor oil. Specific examples of a silicone compound include polydimethylsiloxane. Specific examples of an anionic surfactant include potassium laurate, potassium oleate, sodium lauryl sulfate, sodium alkyl (C14 to C16) sulfonates, and sodium dioctyl sulfosuccinate. Specific examples of a chelating agent include disodium ethylene diamine tetraacetate and trisodium ethylenediamine-N, N'-disuccinate.

The acid value of the first treatment agent is set as appropriate and is preferably not less than 0 mg KOH/g and not more than 20 mg KOH/g, more preferably not less than 0 mg KOH/g and not more than 10 mg KOH/g, and even more preferably not less than 0 mg KOH/g and not more than 5 mg KOH/g. By being specified in such range, the handling property and the stability of the first treatment agent are improved. The acid value can be measured in conformance to "3.2 Potentiometric titration method" of JIS K 0070-1992.

The viscosity at 30° C. of the first treatment agent is set as appropriate and is preferably not more than 40,000 mPa·s and more preferably not more than 35,000 mPa·s. By specifying in such range, the handling property of the first treatment agent and miscibility of the first treatment agent with the second treatment agent are improved. The viscosity is a value measured by a B type viscometer.

The nonvolatile concentration of the first treatment agent is set as appropriate and is preferably not less than 20% by mass and not more than 60% by mass and more preferably not less than 30% by mass and not more than 55% by mass. By specifying in such range, the handling property and the stability of the first treatment agent are improved.

With the first treatment agent, the sodium ion concentration detected from nonvolatile matter of the first treatment agent by an ICP emission spectroscopy method is preferably more than 0 ppm but not more than 10,000 ppm and more preferably more than 0 ppm but not more than 8,000 ppm. By being specified in such range, the handling property and the stability of the first treatment agent are improved further.

The calcium ion concentration detected from nonvolatile matter of the first treatment agent by an ICP emission spectroscopy method is preferably more than 0 ppm but not more than 200 ppm, more preferably more than 0 ppm but not more than 40 ppm, and even more preferably more than 0 ppm but not more than 30 ppm. By being specified in such range, the stability of the first treatment agent is improved and if the mixture in which the first treatment agent and the second treatment agent are mixed is of emulsion form, separation of the emulsion or formation of scum is suppressed and the stability of the emulsion is improved.

The magnesium ion concentration detected from nonvolatile matter of the first treatment agent by an ICP emission spectroscopy method is preferably more than 0 ppm but not more than 150 ppm, more preferably more than 0 ppm but not more than 25 ppm, and even more preferably more than 0 ppm but not more than 10 ppm. By being specified in such range, the stability of the first treatment agent is improved and if the mixture in which the first treatment agent and the second treatment agent are mixed is of emulsion form, separation of the emulsion or formation of scum is suppressed and the stability of the emulsion is improved.

In concentration measurement using an ICP emission spectroscopy method, first, solutions of known metal ion concentrations are prepared and measured with an ICP emission spectrometer to prepare a calibration curve and concentrations can then be determined from detection values of samples.

(Second Treatment Agent)

The first treatment agent is used in combination with the second treatment agent that contains a nonionic surfactant (E). The first treatment agent is arranged as a separate agent from the second treatment agent and, at the time of use, mixed with the second treatment agent. The second treatment agent will now be described.

The second treatment agent contains the nonionic surfactant (E) and may optionally contain an organic phosphate ester compound (D). The second treatment agent may further contain a solvent (T).

(Nonionic Surfactant (E))

The nonionic surfactant (E) improves the stability of the mixture of the first and second treatment agents and improves uniform adherability of the mixture to a synthetic fiber. The nonionic surfactant (E) is excellent in terms of the emulsion stability of the mixture and the uniform adherability of the mixture to a synthetic fiber.

Specific examples of the nonionic surfactant (E) are the same as the specific examples of the nonionic surfactant (C) to be contained in the first treatment agent. With these nonionic surfactants (E), one type of nonionic surfactant may be used alone or two or more types of nonionic surfactant may be used in combination. Among these nonionic surfactants (E), those which contain an amine compound (E1), such as polyoxyethylene alkylamine ethers and acid neutralization products of polyoxyethylene alkylamine ethers, are preferable. By using such a compound, the stability of the mixture is improved further when the mixture is of emulsion form.

The lower limit of the content of the amine compound (E1) in nonvolatile matter of the second treatment agent is set as appropriate and is preferably not less than 20% by mass and more preferably not less than 30% by mass. When not less than 20% by mass, the stability of the second treatment agent is improved further. Also, the stability of the mixture is improved further when the mixture is of emulsion form.

(Solvent (T))

Specific examples of the solvent (T) are the same as the specific examples of the solvent (S) to be contained in the first treatment agent. Among these, a polar solvent, such as water or a lower alcohol is preferable from a standpoint of making the mixture be of emulsion form, and water is more preferable from a standpoint of being excellent in handleability.

The content of the solvent (T) in the second treatment agent is set as appropriate from standpoints of type, handleability, miscibility with the first treatment agent, etc., of the solvent. The lower limit of the content of the solvent (T) in the second treatment agent is preferably not less than 0.01% by mass and more preferably not less than 1% by mass. The upper limit of the content of the solvent (T) in the second treatment agent is preferably not more than 50% by mass, more preferably not more than 40% by mass, and even more preferably not more than 30% by mass.

(Organic Phosphate Ester Compound (D))

The organic phosphate ester compound (D) may be any of the examples of the organic phosphate ester compounds described herein for the phosphate compound (A) to be contained in the first treatment agent.

The content of the organic phosphate ester compound (D) in the second treatment agent is set as appropriate and is preferably not more than 5% by mass, more preferably not more than 2% by mass, and even more preferably not more than 1% by mass. When not more than 5% by mass, the stability of the second treatment agent can be improved.

(Others)

In accordance with an application purpose or necessity and within ranges in which the effects of the present invention are not impaired, the second treatment agent may further contain another component (G), for example, the above-mentioned monohydric aliphatic alcohol (B); a polyhydric alcohol; a mineral oil, an ester, or a silicone compound as a smoothing agent; or a chelating agent.

With the second treatment agent, the calcium ion concentration detected from nonvolatile matter of the second treatment agent by an ICP emission spectroscopy method is preferably not more than 200 ppm and more preferably not more than 40 ppm. By being specified in such range, the stability of the second treatment agent is improved and if the mixture in which the first treatment agent and the second treatment agent are mixed is of emulsion form, separation of the emulsion or formation of scum is suppressed and the stability of the emulsion is improved.

The magnesium ion concentration detected from nonvolatile matter of the second treatment agent by an ICP emission spectroscopy method is preferably not more than 150 ppm and more preferably not more than 25 ppm. By being specified in such range, the stability of the second treatment agent is improved and if the mixture in which the first treatment agent and the second treatment agent are mixed is of emulsion form, separation of the emulsion or formation of scum is suppressed and the stability of the emulsion is improved.

Second Embodiment

Next, a second embodiment that embodies a synthetic fiber treatment agent according to the present invention will be described.

The synthetic fiber treatment agent of the present embodiment contains the first treatment agent and the second treatment agent described for the first embodiment. The synthetic fiber treatment agent is arranged with the first treatment agent and the second treatment agent being separate agents during storage and, at the time of use, prepared as a mixture in which the first treatment agent and the second treatment agent are mixed. In the preparation of the mixture, the first treatment agent and the second treatment agent may be mixed directly or the preparation may be performed by loading the first treatment agent and the second treatment agent in a predetermined order into a separately prepared solvent to dilute to a predetermined concentration.

A mixing ratio of the first treatment agent and the second treatment agent is set as appropriate in accordance with, for example, component contents, miscibility, application, or purpose. Generally, different synthetic fiber treatment agents are imparted in a fiber spinning or stretching process and in a finishing process during the manufacture of a short fiber. In a fiber spinning and stretching process during the manufacture of a general polyester short fiber or polyolefin short fiber, an emulsion of a fiber spinning and stretching process treatment agent of 0.05% to 1.5% by mass as a nonvolatile concentration is imparted to a melt-spun fiber and the fiber is put in a wet state. Next, in a stretching process, the fiber is stretched in a stretching bath filled with the emulsion of the fiber spinning and stretching process treatment agent of 0.05% to 1.5% by mass as a nonvolatile concentration. In the fiber spinning or stretching process, the fiber is in a wet state in both processes. Therefore, in the fiber spinning or stretching process, friction characteristics in the wet state or reduction of foaming in the stretching bath is required and performance specialized for the wet state is needed.

On the other hand, with the synthetic fiber treatment agent imparted in a finishing process, characteristics that are required in processing from a short fiber to a spun yarn or a nonwoven fabric are demanded. The process of processing to a spun yarn or a nonwoven fabric, with the exception of a wet processing process for some nonwoven fabrics such as a spun lace, is generally carried out entirely in a dry state, for example, under an atmosphere of 20° C. to 40° C. and approximately 40% to 70% RH. Especially with a carding process, a drawing process, and a fine spinning process in spun yarn manufacturing or with a carding process in nonwoven fabric manufacturing, friction characteristics or antistatic property in the dry state must be evaluated. Therefore, with short fiber treatment agents, use is often made upon changing a composition between a fiber spinning or stretching oil used in the fiber spinning or stretching process and a finishing oil used in the finishing process.

From a standpoint of fiber spinning and stretching properties, the treatment agent of the present invention is preferably used at a mixing ratio of first treatment agent/second treatment agent=70/30 to 10/90 (mass ratio of nonvolatile matters) as a composition for fiber spinning or stretching. In particular, use at a mixing ratio of first treatment agent/second treatment agent=40/60 to 20/80 (mass ratio of nonvolatile matters) is especially preferable because reduction of foaming or wetting property in the wet state can be improved thereby. Similarly, from a standpoint of yarn spinning properties, first treatment agent/second treatment agent=40/60 to 90/10 (mass ratio of nonvolatile matters) is preferable and 50/50 to 80/20 (mass ratio of nonvolatile matters) is more preferable as a composition for finishing.

In a mode where the first treatment agent and the second treatment agent are used in combination, the mixing ratio of the first treatment agent and the second treatment agent can be changed arbitrarily. It is thus made easy to finely adjust the mixing ratio and prepare the treatment agent for obtaining the optimal fiber spinning and stretching properties at all times even under conditions with differences in manufacturing conditions, such as a difference in manufacturing equipment or a difference in climate such as temperature and humidity. Stable fiber manufacturing is thereby made possible.

The operation and effects of the first treatment agent and the synthetic fiber treatment agent of the above-described embodiments will now be described.

(1-1) The first treatment agent of the above-described embodiment contains specific phosphate compound (A) and solvent (S) and further optionally contains a specific amount of a specific nonionic surfactant (C). Also, with the synthetic fiber treatment agent, the first treatment agent and the second treatment agent that contains the nonionic surfactant (E) are stored as separate agents and mixed at the time of use. Therefore, the stabilities and especially storage stabilities of the first treatment agent and the second treatment agent that constitute the synthetic fiber treatment agent can be improved. The stability of the first treatment agent is improved because in the first treatment agent, the content ratio of the nonionic surfactant and the organic phosphate compound is within a predetermined range. Further, the first treatment agent is mixed with the second treatment agent at the time of use and therefore, the stability of the mixture of emulsion form can also be improved by the surfactant. Deterioration of uniform adherability of the phosphate compound (A) and other components to a fiber therefore does not occur. Antistatic property and other effects can thus be exhibited effectively by the phosphate compound (A) and other components contained in the synthetic fiber treatment agent.

Third Embodiment

Next, a third embodiment that embodies a method for preparing an aqueous liquid of a synthetic fiber treatment agent according to the present invention (hereinafter referred to as the "aqueous liquid preparation method") will be described.

The aqueous liquid preparation method of the present embodiment is a method in which the first treatment agent and the second treatment agent of the first embodiment are added to water to prepare an aqueous liquid with a nonvolatile concentration of not less than 0.01% by mass and not more than 10% by mass.

As a method for adding the first treatment agent and the second treatment agent to water, a known method can be adopted as appropriate and preferably a first step described below and a second step described below are included. By such a method, if the mixture of the first treatment agent and the second treatment agent is of emulsion form, the stability of the emulsion is improved further.

In the first step, the first treatment agent and the second treatment agent are added to a first water to prepare a mother aqueous liquid of the synthetic fiber treatment agent with a nonvolatile concentration of more than 2% by mass but not more than 10% by mass. The order of adding the first treatment agent and the second treatment agent to the first water is not particularly limited and the first treatment agent may be added to the water first and the second treatment agent may be added to the water next or the second treatment agent may be added to the water first and the first treatment agent may be added to the water next. Alternatively, the first treatment agent and the second treatment agent may be added to the water at the same time. A temperature of water for dilution is not particularly limited. From a standpoint of improvement of the stability of the emulsion, it is preferable to add the first treatment agent to the first water first and to add the second treatment agent to the first water next.

The first step preferably includes a step of heating 20% to 70% by mass of the total amount of the first water to 60° C. to 95° C., adding the first treatment agent and the second treatment agent to the heated water, and thereafter further adding thereto the remaining 30% to 80% by mass of the first water that has been adjusted to not more than 40° C. By such a method, if the mixture of the first treatment agent and the second treatment agent is of emulsion form, the stability of the emulsion is improved further. Even in this case, the order of adding the first treatment agent and the second treatment agent to the water is not particularly limited and the first treatment agent may be added to the water first and the second treatment agent may be added to the water next or the second treatment agent may be added to the water first and the first treatment agent may be added to the water next. Alternatively, the first treatment agent and the second treatment agent may be added to the water at the same time. From a standpoint of improvement of the stability of the emulsion, it is preferable to add the first treatment agent to the first water first and to add the second treatment agent to the first water next.

Alternatively, the first step may include a step of heating 20% to 70% by mass of the total amount of the first water to 60° C. to 95° C., adding the first treatment agent to the heated water, thereafter further adding thereto the remaining 30% to 80% by mass of the first water that has been adjusted to not more than 40° C., and thereafter lastly adding thereto the second treatment agent. By such a method, if the mixture of the first treatment agent and the second treatment agent is of emulsion form, the stability of the emulsion is improved further.

In the second step, a second water is added to the mother aqueous liquid of the synthetic fiber treatment agent prepared in the first step to prepare an aqueous liquid with a nonvolatile concentration of not less than 0.01% by mass and not more than 2% by mass.

The operation and effects of the method for preparing the aqueous liquid of the above-described embodiment will now be described.

(2-1) The aqueous liquid preparation method of the above-described embodiment is a method in which the first treatment agent and the second treatment agent are added to water to prepare an aqueous liquid with a nonvolatile concentration of not less than 0.01% by mass and not more than 10% by mass. Therefore, if the mixture of the first treatment agent and the second treatment agent is of emulsion form, the stability of the emulsion is improved. Also, the aqueous liquid that is of fiber imparting form can be prepared by mixing the first treatment agent and the second treatment agent, which have been prepared in advance, with water and therefore, the aqueous liquid can be prepared easily in comparison to a method of formulating from reagents at the time of use.

(2-2) If the step of adding the first treatment agent and the second treatment agent to water to prepare a mother aqueous liquid of the synthetic fiber treatment agent with a nonvolatile concentration of more than 2% by mass but not more than 10% by mass is taken, the stability of the emulsion is improved further. The effects due to the respective components in the synthetic fiber treatment agent can thereby be exhibited effectively without deterioration of uniform adherability of the components to a fiber.

The present embodiment may be modified as follows. The present embodiment and the following modification can be implemented upon being combined with each other within a range that is not technically inconsistent.

In the aqueous liquid preparation method of the present embodiment, it is preferable from a standpoint of defoaming property during fiber manufacturing and improvement of yarn spinning performance of fiber to further add a silicone composition in any step selected from the first step and the second step of preparing the aqueous liquid. Specific examples of the silicone composition are not particularly limited and, for example, polydimethylsiloxane and polyoxyethylene modified silicone are preferable. From a standpoint of the stability of the aqueous liquid, the addition of the silicone composition is more preferably performed in the second step.

Fourth Embodiment

Next, a fourth embodiment that embodies a method for treating a synthetic fiber according to the present invention will be described.

The method for treating the synthetic fiber of the present embodiment is a method in which an aqueous liquid of a synthetic fiber treatment agent obtained by adding the first treatment agent and the second treatment agent to water is imparted to a synthetic fiber, for example, in a fiber spinning or stretching process or a finishing process. As a method for preparing the aqueous liquid, the aqueous liquid preparation method of the third embodiment can be adopted. The water in the aqueous liquid adhered to the synthetic fiber may be evaporated by a drying step.

Specific examples of the fiber to which the aqueous liquid is imparted are not particularly limited and include (1) a polyester fiber, such as polyethylene terephthalate (PET), polytrimethylene terephthalate, polybutylene terephthalate, polyethylene naphthalate, polylactic acid, or a composite fiber containing these polyester resins, (2) a polyamide fiber, such as nylon 6 or nylon 66, (3) a polyacrylic fiber, such as polyacrylic or modacrylic, and (4) a polyolefin fiber, such as polyethylene and polypropylene. Preferably, the aqueous liquid is applied to a polyester fiber or a polyolefin fiber from a standpoint that the effect of uniformly imparting the treatment agent is exhibited excellently by improvement of wetting property.

The synthetic fiber to which the aqueous liquid is imparted in the finishing process is not particularly limited in its use, and is used, for example, as a short fiber, a spun yarn, or a nonwoven fabric. It can be used in both a short fiber application and a long fiber application, but it is preferred to be used as a short fiber. Short fibers may be generally called staple fibers and do not include long fibers that may be generally called filament fibers. The length of a short fiber is not particularly limited as long as the short fiber has a length corresponding to the length of a short fibers in the art and, for example, is preferably not more than 100 mm.

The amount of adhering the aqueous liquid to the synthetic fiber is not particularly limited and preferably, the aqueous liquid is adhered such as to be of a ratio of 0.1% to 3% by mass (not including water or other solvent) with respect to the synthetic fiber. By such arrangement, the effects due to the respective components in the synthetic fiber treatment agent can be exhibited effectively. The method for adhering the treatment agent is not particularly limited and a known method, for example, a roller oiling method, a guide oiling method using a metering pump, an immersion oiling method, or a spray oiling method can be adopted in accordance with type and form of the synthetic fiber.

The operation and effects of the method for treating the synthetic fiber of the present embodiment will now be described.

(3-1) The method for treating the synthetic fiber of the present embodiment is a method in which an aqueous liquid of a synthetic fiber treatment agent is imparted to a synthetic fiber, for example, in a fiber spinning or stretching process or a finishing process. Therefore, the effects on, for example, a short fiber, a spun yarn, and a nonwoven fabric due to the respective components in the synthetic fiber treatment agent can be exhibited effectively without deterioration of uniform adherability of the respective components to the synthetic fiber.

The above-described embodiments may be modified as follows. The above-described embodiments and the following modification can be implemented upon being combined with each other within a range that is not technically inconsistent.

Each of the treatment agents of the above-described embodiments may further include a stabilizer, an antistatic agent, a binder, an antioxidant, an ultraviolet absorber, and other components ordinarily used in the treatment agent for quality maintenance of the treatment agent within a range that does not impair the effects of the present invention.

EXAMPLES

Examples will now be given below to describe the features and effects of the present invention more specifically, but the present invention is not limited to these examples. In the following description of working examples and comparative examples, "parts" means parts by mass and, unless particularly limited, "%" means % by mass.

Experimental Part 1 (Preparation of First Treatment Agent)

First treatment agents were prepared using the respective components shown in Tables 1 and 2 and by the following preparation method.

Phosphate Compound (A)

As the phosphate compounds (A), A-1 to A-26 and a-1 shown in Table 1 were used. The type of each phosphate compound (A), the P nucleus NMR integral ratio (%) of the inorganic phosphate compound in each phosphate compound (A), and the P nucleus NMR integral ratios (%) of P1 to P3 when the total for P1 to P3 is taken as 100% are respectively indicated in the "Phosphate compound (A)" column, the "P nucleus NMR integral ratio (%) of inorganic phosphate compound in phosphate compound (A)" column, and "P nucleus integral ratios (%)" column of Table 1. The P nucleus NMR integral ratio (%) was measured by the P nucleus NMR measurement method described below.

P Nucleus NMR Measurement Method

For the P nucleus NMR integral ratios of each phosphate compound (A), first, the phosphate compound was pretreated by adding an excess of KOH and adjusting the pH to 12 or higher. By this pretreatment, the peaks attributed to the phosphate ester P1, the phosphate ester P2, the phosphate ester P3, and the inorganic phosphate compound can be separated clearly in $^{31}$P-NMR measurement. The P nucleus NMR integral ratios were measured with a $^{31}$P-NMR spectrometer (trade name MERCURY plus NMR Spectrometer System, 300 MHz manufactured by VALIAN; the same applies hereinafter). As a solvent, a mixed solvent of heavy water/tetrahydrofuran=8/2 (volume ratio) was used.

An integral value of signals appearing at 4 ppm to 10 ppm among the signals obtained corresponds to the P atom in tripotassium phosphate (this integral value is referred to as "Phosphate_P"). An integral value of signals appearing at 3 ppm to 7 ppm corresponds to the P atom in P1 (this integral value is referred to as "P1_P"). An integral value of signals appearing at −1 ppm to 4 ppm corresponds to the P atom in P2 (this integral value is referred to as "P2_P"). An integral value of signals appearing at −1 ppm to −20 ppm corresponds to the P atom in P3 (this integral value is referred to as "P3_P").

However, when signals are detected with the ranges for the above values being overlapped, signals derived from the P atoms corresponding to the inorganic phosphate and the phosphate esters P1, P2, and P3 are detected in that order from the low magnetic field side. The above-mentioned signal positions are of values at which signals generally appear and if a signal appears in a range of −5 ppm to −20 ppm by P nucleus integration, four signals including that signal are selected in an order starting from the signal of highest integral value and these become the inorganic phosphate compound and phosphate ester P1, P2, and P3 components in the order starting from that at the low magnetic field side. If a signal is not detected in the range of −5 ppm to −20 ppm, three signals are selected in an order starting from the detected signal of largest integral value and these become the inorganic phosphate compound and phosphate ester P1 and P2 components in the order starting from that at the low magnetic field side.

When the total of the P nucleus NMR integral ratios attributed to the phosphate ester P1, the phosphate ester P2, the phosphate ester P3, and the inorganic phosphate compound is taken as 100%, the P nucleus NMR integral ratio attributed to the inorganic phosphate compound is expressed by Numerical Formula (1) described above.

With the phosphate compound (A), when the total of the P nucleus NMR integral ratios attributed to the phosphate ester P1, the phosphate ester P2, and the phosphate ester P3 is taken as 100%, the P nucleus NMR integral ratio attributed to the phosphate ester P1 is expressed by Numerical Formula (2) described above, the P nucleus NMR integral ratio attributed to the phosphate ester P2 is expressed by Numerical Formula (3) described above, and the P nucleus NMR integral ratio attributed to the phosphate ester P3 is expressed by Numerical Formula (4) described above.

TABLE 1

| Type | Phosphate compound (A) | P nucleus NMR integral ratio (%) of inorganic phosphate compound in phosphate compound (A) | P nucleus integral ratios (%) (when total for P1 to P3 is taken as 100%) | | |
|---|---|---|---|---|---|
| | | | P1 | P2 | P3 |
| A-1 | Potassium stearyl phosphate - 1 | 2.4% | 39.7 | 38.4 | 21.9 |
| A-2 | Potassium stearyl phosphate - 2 | 1.7% | 53.0 | 41.5 | 5.5 |
| A-3 | Potassium stearyl phosphate - 3 | 0.7% | 49.3 | 40.3 | 10.4 |
| A-4 | Potassium stearyl phosphate - 4 | 0.9% | 55.8 | 44.2 | 0.0 |
| A-5 | Potassium stearyl phosphate - 5 | 0.4% | 45.1 | 46.9 | 8.0 |
| A-6 | Potassium stearyl phosphate - 6 | 0.8% | 56.4 | 43.6 | 0.0 |
| A-7 | Potassium stearyl phosphate - 7 | 0.6% | 46.4 | 44.6 | 9.0 |
| A-8 | Potassium stearyl phosphate - 8 | 0.9% | 56.7 | 43.3 | 0.0 |
| A-9 | Potassium stearyl phosphate - 9 | 0.8% | 58.5 | 41.5 | 0.0 |
| A-10 | Potassium stearyl phosphate - 10 | 3.7% | 74.5 | 25.5 | 0.0 |
| A-11 | Potassium stearyl phosphate - 11 | 1.0% | 59.1 | 39.3 | 1.6 |
| A-12 | Potassium stearyl phosphate - 12 | 15.5% | 88.5 | 11.5 | 0.0 |
| A-13 | Potassium stearyl phosphate - 13 | 15.8% | 59.3 | 39.2 | 1.5 |
| A-14 | Potassium stearyl phosphate - 14 | 11.3% | 85.7 | 14.3 | 0.0 |
| A-15 | Potassium stearyl phosphate - 15 | 3.3% | 75.0 | 25.0 | 0.0 |
| A-16 | Potassium stearyl phosphate - 16 | 2.8% | 61.9 | 37.0 | 1.1 |
| A-17 | Potassium cetyl/stearyl phosphate - 1 (cetyl/stearyl = 70/30) | 2.8% | 55.7 | 38.6 | 5.7 |
| A-18 | Potassium cetyl/stearyl phosphate - 2 (cetyl/stearyl = 30/70) | 2.1% | 50.0 | 33.1 | 16.9 |
| A-19 | Potassium cetyl/stearyl phosphate - 3 (cetyl/stearyl = 70/30) | 1.9% | 57.1 | 39.0 | 3.9 |
| A-20 | Potassium cetyl phosphate - 1 | 1.7% | 45.0 | 38.8 | 16.2 |
| A-21 | Potassium cetyl phosphate - 2 | 1.2% | 49.4 | 39.3 | 11.3 |
| A-22 | Potassium cetyl phosphate - 3 | 0.8% | 54.7 | 45.3 | 0.0 |
| A-23 | Potassium cetyl phosphate - 4 | 2.5% | 39.9 | 37.7 | 22.4 |
| A-24 | Potassium cetyl phosphate - 5 | 2.7% | 62.7 | 37.3 | 0.0 |
| A-25 | Potassium stearyl phosphate - 17 | 1.0% | 55.6 | 44.4 | 0.0 |
| A-26 | Potassium stearyl phosphate - 18 | 0.6% | 44.6 | 46.8 | 8.6 |
| a-1 | Potassium stearyl phosphate - 19 | 25.0% | 88.2 | 11.8 | 0 |

First Treatment Agent

A first treatment agent 1-1 was prepared that contains 38.8 parts (%) of potassium stearyl phosphate (A-1) shown in Table 1 as the phosphate compound (A), 1.2 parts (%) of stearyl alcohol (Ba-1) as the monohydric aliphatic alcohol, and 60 parts (%) of water (S-1) as the solvent.

As with the first treatment agent 1-1, first treatment agents 1-2 to 1-54 were each prepared by mixing a phosphate compound and a solvent and, as necessary, a monohydric aliphatic alcohol, a nonionic surfactant, and other components (F) at the ratios shown in Table 2.

The type and content of each phosphate compound (A), the type and content of each monohydric aliphatic alcohol (B), the content of the nonionic surfactant (Ca-1), the type and content of each of the other components (F), the content of the solvent (S-1), the nonvolatile concentration of each first treatment agent, the content of the monohydric aliphatic alcohol (B) in the nonvolatile content, the mass ratio of the content of the phosphate compound (A) and the content of the nonionic surfactant (Ca-1) are respectively indicated in the "Phosphate compound (A)" column, the "Monohydric aliphatic alcohol (B)" column, the "Nonionic surfactant (Ca-1)" column, the "Other component (F)" column, the "Solvent (S-1)" column, the "Nonvolatile concentration" column, the "Content ratio of (B) in nonvolatile content" column, and the "Content ratio of (A) and (Ca-1)" column of Table 2. The nonvolatile concentration of each first treatment agent was measured by the following method.

Nonvolatile Concentration 1 g of sample is dispensed onto an aluminum tray the mass of which has been measured in advance. The nonvolatile concentration is calculated from the mass of absolute dry matter obtained after 2 hours of heat treatment at 105° C.

Nonvolatile concentration(%)=(Mass of absolute dry matter obtained after heat treatment)/(Mass of sample before heat treatment)×100

Ion concentrations detected from the nonvolatile matter and the acid value and the viscosity at 30° C. of each first treatment agent are respectively indicated in the "Ion concentrations detected from nonvolatile matter" column, the "Acid value" column, and the "Viscosity at 30° C." column of Table 2. The acid value and the viscosity of each first treatment agent were measured by the methods described below. The ion concentrations detected from the nonvolatile matter were measured by the ICP emission spectroscopy method described below.

Acid Value

Measurement was made in accordance with "3.2 Potentiometric titration method" of JIS K 0070-1992. A sampling amount of each sample was 10 g and a mixed solvent of ethanol/xylene=½ was used as a solvent.

Viscosity 250 g of sample is placed in a tall beaker (height: 13.5 cm) of 300 mL capacity. The sample is temperature adjusted to 30° C. in advance and measurement is made while maintaining the temperature using a water bath of 30° C. The measurement was made using the digital B type viscometer model DVL-B manufactured by TOKYO KEIKI INC. and while selecting an optimal rotor and rotation speed according to viscosity in accordance with an operation manual.

ICP Emission Spectroscopy Method

First, each first treatment agent is diluted using distilled water such that the nonvolatile concentration is 0.1%. As standard solutions of each of Ca, K, Mg, Na, P, and Si, solutions of respective known concentrations 0.5 ppm, 1 ppm, 5 ppm, and 10 ppm are prepared. If a value of not less than 10 ppm is obtained in a measurement using the above, solutions of 10 ppm, 50 ppm, 100 ppm, and 500 ppm are measured again as standard solutions. The distilled water used for sample dilution is used as a standard solution of 0 ppm. If in a measurement using the above, an upper limit of the calibration curve is exceeded, measurement is made upon diluting the sample further by 10 times with distilled water. Measurement was made using an JCP emission spectrometer JCPE-9000 manufactured by Shimadzu Corporation).

TABLE 2

| First treatment agent | Phosphate compound (A) Type | Phosphate compound (A) Ratio (%) | Monohydric aliphatic alcohol (B) Type | Monohydric aliphatic alcohol (B) Ratio (%) | Nonionic surfactant (Ca-1) Ratio (%) | Other component (F) Type | Other component (F) Ratio (%) | Solvent (S-1) Ratio (%) | Nonvolatile concentration (%) | Content ratio of (B) in nonvolatile content (%) | Content ratio of (A) and (Ca-1) (A/Ca-1) |
|---|---|---|---|---|---|---|---|---|---|---|---|
| 1-1 | A-1 | 38.8 | Ba-1 | 1.2 | | | | 60 | 40 | 3.0 | 100/0 |
| 1-2 | A-2 | 36 | Ba-1 | 4 | | | | 60 | 40 | 10.0 | 100/0 |
| 1-3 | A-3 | 38 | Ba-1 | 2 | | | | 60 | 40 | 5.0 | 100/0 |
| 1-4 | A-4 | 38.4 | Ba-1 | 1.6 | | | | 60 | 40 | 4.0 | 100/0 |
| 1-5 | A-5 | 37.6 | Ba-1 | 2.4 | | | | 60 | 40 | 6.0 | 100/0 |
| 1-6 | A-6 | 37.2 | Ba-1 | 2.8 | | | | 60 | 40 | 7.0 | 100/0 |
| 1-7 | A-7 | 38 | Ba-1 | 2 | | | | 60 | 40 | 5.0 | 100/0 |
| 1-8 | A-8 | 38 | Ba-1 | 2 | | | | 60 | 40 | 5.0 | 100/0 |
| 1-9 | A-9 | 37.2 | Ba-1 | 2.8 | | | | 60 | 40 | 7.0 | 100/0 |
| 1-10 | A-10 | 38.8 | Ba-1 | 1.2 | | | | 60 | 40 | 3.0 | 100/0 |
| 1-11 | A-11 | 36.8 | Ba-1 | 3.2 | | | | 60 | 40 | 8.0 | 100/0 |
| 1-12 | A-12 | 33.6 | Ba-1 | 6.4 | | | | 60 | 40 | 16.0 | 100/0 |
| 1-13 | A-13 | 37.2 | Ba-1 | 2.8 | | | | 60 | 40 | 7.0 | 100/0 |
| 1-14 | A-14 | 33.2 | Ba-1 | 6.8 | | | | 60 | 40 | 17.0 | 100/0 |
| 1-15 | A-15 | 33.6 | Ba-1 | 6.4 | | | | 60 | 40 | 16.0 | 100/0 |
| 1-16 | A-16 | 38.8 | Ba-1 | 1.2 | | | | 60 | 40 | 3.0 | 100/0 |
| 1-17 | A-1 | 34 | Ba-1 | 3.8 | | | | 60 | 40 | 15.0 | 100/0 |
| | | | Ba-3 | 2.2 | | | | | | | |
| 1-18 | A-1 | 34 | Ba-1 | 3.8 | | | | 60 | 40 | 15.0 | 100/0 |
| | | | Ba-4 | 2.2 | | | | | | | |
| 1-19 | A-3 | 36.8 | Ba-1 | 1.2 | | | | 60 | 40 | 8.0 | 100/0 |
| | | | Ba-5 | 2 | | | | | | | |
| 1-20 | A-4 | 36.8 | Ba-1 | 1.2 | | Fa-1 | 2 | 60 | 40 | 3.0 | 100/0 |
| 1-21 | A-5 | 35.6 | Ba-1 | 2.4 | | Fa-2 | 2 | 60 | 40 | 6.0 | 100/0 |
| 1-22 | A-6 | 35.2 | Ba-1 | 2.6 | | Fa-3 | 2.2 | 60 | 40 | 6.5 | 100/0 |
| 1-23 | A-1 | 37.6 | Ba-1 | 2.2 | | Fd-1 | 0.2 | 60 | 40 | 5.5 | 100/0 |
| 1-24 | A-16 | 33.6 | Ba-1 | 1 | | Fe-1 | 5 | 60 | 40 | 2.5 | 100/0 |
| | | | | | | Ff-1 | 0.4 | | | | |
| 1-25 | A-1 | 32.4 | Ba-1 | 3.6 | 0.6 | Fb-1 | 2.8 | 60 | 40 | 9.0 | 98.2/1.8 |
| | | | | | | Fc-2 | 0.6 | | | | |
| 1-26 | A-1 | 24.3 | Ba-1 | 2.7 | 0.45 | Fb-2 | 2.1 | 70 | 30 | 9.0 | 98.2/1.8 |
| | | | | | | Fc-1 | 0.45 | | | | |
| 1-27 | A-17 | 36.8 | Ba-1 | 2 | | | | 60 | 40 | 8.0 | 100/0 |
| | | | Ba-2 | 1.2 | | | | | | | |
| 1-28 | A-18 | 38.8 | Ba-1 | 0.4 | | | | 60 | 40 | 3.0 | 100/0 |
| | | | Ba-2 | 0.8 | | | | | | | |
| 1-29 | A-19 | 38.4 | Ba-1 | 1.2 | | | | 60 | 40 | 4.0 | 100/0 |
| | | | Ba-2 | 0.4 | | | | | | | |
| 1-30 | A-20 | 41.4 | Ba-2 | 3.6 | | | | 55 | 45 | 8.0 | 100/0 |
| 1-31 | A-21 | 52.8 | Ba-2 | 2.2 | | | | 45 | 55 | 4.0 | 100/0 |
| 1-32 | A-22 | 38 | Ba-2 | 2 | | | | 60 | 40 | 5.0 | 100/0 |
| 1-33 | A-23 | 33.95 | Ba-2 | 1.05 | | | | 65 | 35 | 3.0 | 100/0 |
| 1-34 | A-24 | 38.4 | Ba-2 | 1.6 | | | | 60 | 40 | 4.0 | 100/0 |
| 1-35 | A-20 | 40.5 | Ba-2 | 3.6 | | Fc-3 | 0.45 | 55 | 45 | 8.0 | 100/0 |
| | | | | | | Fe-2 | 0.45 | | | | |
| 1-36 | A-21 | 50 | Ba-2 | 2.2 | | Fc-4 | 1.1 | 45 | 55 | 4.0 | 100/0 |
| | | | | | | Fe-2 | 1.1 | | | | |
| | | | | | | Ff-2 | 0.6 | | | | |
| 1-37 | A-1 | 34.8 | Ba-1 | 1.2 | | Fe-4 | 4 | 60 | 40 | 3.0 | 100/0 |
| 1-38 | A-2 | 32.4 | Ba-1 | 3.6 | | Fe-5 | 4 | 60 | 40 | 9.0 | 100/0 |
| 1-39 | A-3 | 34 | Ba-1 | 2 | | Fe-6 | 4 | 60 | 40 | 5.0 | 100/0 |
| 1-40 | A-16 | 34 | Ba-1 | 1.2 | | Fe-1 | 2.8 | 60 | 40 | 3.0 | 100/0 |
| | | | | | | Ff-1 | 2 | | | | |
| 1-41 | A-1 | 40 | | | | | | 60 | 40 | 0.0 | 100/0 |
| 1-42 | A-2 | 40 | | | | | | 60 | 40 | 0.0 | 100/0 |
| 1-43 | A-3 | 40 | | | | | | 60 | 40 | 0.0 | 100/0 |
| 1-44 | A-4 | 40 | | | | | | 60 | 40 | 0.0 | 100/0 |
| 1-45 | A-5 | 40 | | | | | | 60 | 40 | 0.0 | 100/0 |
| 1-46 | A-17 | 40 | | | | | | 60 | 40 | 0.0 | 100/0 |
| 1-47 | A-18 | 40 | | | | | | 60 | 40 | 0.0 | 100/0 |
| 1-48 | A-19 | 40 | | | | | | 60 | 40 | 0.0 | 100/0 |
| 1-49 | A-20 | 45 | | | | | | 55 | 45 | 0.0 | 100/0 |

TABLE 2-continued

| | | | | | | | | | | | |
|---|---|---|---|---|---|---|---|---|---|---|---|
| 1-50 | A-21 | 55 | | | | | 45 | 55 | 0.0 | 100/0 |
| 1-51 | A-1 | 37.2 | | | Fe-3 | 2.8 | 60 | 40 | 0.0 | 100/0 |
| 1-52 | A-25 | 38.4 | Ba-1 | 1.6 | | | 60 | 40 | 4.0 | 100/0 |
| 1-53 | A-26 | 37.6 | Ba-1 | 2.4 | | | 60 | 40 | 6.0 | 100/0 |
| 1-54 | a-1 | 45 | | | | | 55 | 45 | 0.0 | 100/0 |

| | First treatment agent | Ion concentrations detected from nonvolatile matter (ppm) Ca | K | Mg | Na | P | Si | Acid value (mgKOH/g) | Viscosity at 30° C. (mPa · s) | Evaluation Storage stability |
|---|---|---|---|---|---|---|---|---|---|---|
| | 1-1 | 17 | 100000 | 5 | 1050 | 62000 | 200 | 5 | 9000 | ○○ |
| | 1-2 | 10 | 97000 | 2 | 500 | 52000 | 30 | 10 | 20000 | ○○ |
| | 1-3 | 16 | 97000 | 4 | 750 | 57000 | 300 | 6 | 35000 | ○○ |
| | 1-4 | 8 | 95000 | 1 | 550 | 53000 | 85 | 7 | 15000 | ○○ |
| | 1-5 | 5 | 94000 | 1 | 1000 | 54000 | 35 | 8 | 20000 | ○○ |
| | 1-6 | 15 | 77000 | 3 | 800 | 55000 | 50 | 7.5 | 18000 | ○○ |
| | 1-7 | 1 | 94000 | 2 | 950 | 50000 | 65 | 6 | 24000 | ○○ |
| | 1-8 | 7 | 74000 | 1 | 750 | 55000 | 40 | 5 | 21000 | ○○ |
| | 1-9 | 5 | 76000 | 2 | 750 | 54000 | 60 | 5 | 18000 | ○○ |
| | 1-10 | 15 | 130000 | 1 | 1150 | 55000 | 100 | 2 | 300 | ○○ |
| | 1-11 | 20 | 100000 | 3 | 900 | 51000 | 80 | 4 | 19000 | ○○ |
| | 1-12 | 18 | 185000 | 2 | 2100 | 67000 | 75 | 5 | 20000 | ○ |
| | 1-13 | 27 | 160000 | 2 | 1300 | 61000 | 35 | 5 | 17000 | ○ |
| | 1-14 | 12 | 170000 | 4 | 1400 | 62000 | 50 | 5 | 22000 | ○ |
| | 1-15 | 21 | 130000 | 5 | 1000 | 55000 | 30 | 5 | 21000 | ○ |
| | 1-16 | 3 | 110000 | 1 | 2200 | 54000 | 30 | 5.5 | 1000 | ○○ |
| | 1-17 | 12 | 99000 | 2 | 500 | 54500 | 60 | 9.5 | 21000 | ○○ |
| | 1-18 | 7 | 95000 | 2 | 450 | 51000 | 40 | 9 | 20000 | ○○ |
| | 1-19 | 13 | 98000 | 3 | 900 | 61000 | 20 | 4.5 | 9000 | ○○ |
| | 1-20 | 7 | 96000 | 2 | 600 | 54000 | 60 | 7 | 13000 | ○○ |
| | 1-21 | 6 | 94500 | 1 | 1000 | 54000 | 20 | 7.5 | 17000 | ○○ |
| | 1-22 | 12 | 79000 | 2 | 700 | 54000 | 90 | 7.5 | 18000 | ○○ |
| | 1-23 | 28 | 102000 | 2 | 700 | 54000 | 1870 | 10 | 25000 | ○○ |
| | 1-24 | 3.3 | 133000 | 2 | 4600 | 54000 | 300 | 3 | 300 | ○○ |
| | 1-25 | 15 | 93000 | 2.5 | 350 | 48000 | 150 | 10.5 | 13000 | ○ |
| | 1-26 | 17 | 92000 | 3 | 400 | 49000 | 170 | 7.5 | 10000 | ○ |
| | 1-27 | 25 | 88000 | 3 | 550 | 53000 | 0 | 15 | 7000 | ○○ |
| | 1-28 | 4 | 118000 | 1 | 1700 | 65000 | 85 | 4.5 | 400 | ○○ |
| | 1-29 | 10 | 106000 | 1 | 1300 | 58000 | 1 | 15 | 15000 | ○○ |
| | 1-30 | 11 | 95000 | 2 | 1200 | 64000 | 70 | 14 | 7000 | ○○ |
| | 1-31 | 12 | 94000 | 3 | 800 | 55000 | 200 | 14 | 10000 | ○○ |
| | 1-32 | 6 | 98000 | 2 | 650 | 51000 | 50 | 13 | 6000 | ○○ |
| | 1-33 | 14 | 98000 | 5 | 950 | 63500 | 250 | 13 | 5000 | ○○ |
| | 1-34 | 34 | 125000 | 2 | 1900 | 52000 | 40 | 5 | 800 | ○○ |
| | 1-35 | 10 | 97000 | 2 | 1200 | 65000 | 90 | 13 | 8000 | ○○ |
| | 1-36 | 12 | 100000 | 3 | 6500 | 53000 | 20 | 13 | 7000 | ○○ |
| | 1-37 | 5 | 92000 | 1 | 4200 | 52000 | 200 | 5 | 8000 | ○○ |
| | 1-38 | 12 | 85000 | 5 | 3800 | 49000 | 150 | 3 | 5500 | ○○ |
| | 1-39 | 10 | 88000 | 2 | 4500 | 51000 | 210 | 3 | 20000 | ○○ |
| | 1-40 | 3.5 | 129000 | 2 | 12000 | 56000 | 280 | 3 | 700 | ○ |
| | 1-41 | 10 | 101000 | 1 | 500 | 59000 | 35 | 11 | 19000 | ○ |
| | 1-42 | 20 | 105000 | 5 | 800 | 61000 | 310 | 6.5 | 32000 | ○ |
| | 1-43 | 20 | 100000 | 3 | 1200 | 65000 | 220 | 5 | 10000 | ○ |
| | 1-44 | 12 | 99000 | 2 | 600 | 55000 | 100 | 7.5 | 15000 | ○ |
| | 1-45 | 6 | 110000 | 1 | 1100 | 58500 | 60 | 8.5 | 18000 | ○ |
| | 1-46 | 24 | 96000 | 5 | 600 | 58500 | 20 | 16 | 6000 | ○ |
| | 1-47 | 4 | 120000 | 2 | 1900 | 68000 | 130 | 4.5 | 400 | ○ |
| | 1-48 | 13 | 120000 | 1 | 1400 | 60500 | 20 | 15.5 | 15000 | ○ |
| | 1-49 | 15 | 100000 | 1 | 1200 | 70000 | 75 | 15 | 6000 | ○ |
| | 1-50 | 11 | 95000 | 2 | 700 | 58000 | 150 | 14.5 | 7000 | ○ |
| | 1-51 | 9 | 109000 | 4 | 600 | 56000 | 60 | 11 | 300 | ○ |
| | 1-52 | 250 | 95000 | 1 | 550 | 53000 | 85 | 7 | 17000 | ○ |
| | 1-53 | 5 | 94000 | 200 | 1000 | 54000 | 35 | 8 | 21000 | ○ |
| | 1-54 | 15 | 210000 | 2 | 1900 | 70000 | 50 | 4 | 1000 | xx |

Details of the monohydric alcohols (B), nonionic surfactants (Ca-1), other components (F), and solvent (S-1) indicated in Table 2 are as follows.

(Monohydric Aliphatic Alcohol (B))

Ba-1: Stearyl alcohol

Ba-2: Cetyl alcohol

Ba-3: Lauryl alcohol

Ba-4: Octyl alcohol

Ba-5: Isostearyl alcohol (Nonionic Surfactant (Ca-1))

Polyoxyethylene (20 moles (added number of moles of ethylene oxide; the same applies hereinafter) oleyl ether Other Component (F)

Fa-1: Propylene glycol

Fa-2: Diethylene glycol

Fa-3: Ethylene glycol

Fb-1: Paraffin wax (melting point: 56° C.)

Fb-2: Hydrotreated light paraffin

Fc-1: Sorbitan monooleate

Fc-2: Sorbitan monostearate
Fc-3: Glycerin monooleate
Fc-4: Castor oil
Fd-1: Polydimethylsiloxane
Fe-1: Potassium laurate
Fe-2: Potassium oleate
Fe-3: Potassium butyl phosphate
Fe-4: Sodium lauryl sulfate
Fe-5: Sodium alkyl (C14-16) sulfonate
Fe-6: Sodium dioctyl sulfosuccinate
Ff-1: Disodium ethylene diamine tetraacetate
Ff-2: Trisodium ethylenediamine-N,N'-disuccinate
(Solvent (S-1))
Water

Experimental Part 2 (Preparation of Second Treatment Agent)

A second treatment agent 2-1 was prepared by mixing well and making uniform 29.9 parts (%) of (polyoxyethylene) (polyoxypropylene) (m+n=8; m is the number of oxyethylene units and n is the number of oxypropylene units (the same applies hereinafter)) C12-13 alkyl ether (Ea-10), 29.9 parts (%) of polyoxyethylene (10 moles) C12-13 alkyl ether (Ea-11), and 39.7 parts (%) of polyoxyethylene (10 moles) dodecylamine (E1-2) as the nonionic surfactants (E) and 0.5 parts (%) of water (T-1).

As with the second treatment agent 2-1, second treatment agents 2-2 to 2-40 were each prepared by mixing nonionic surfactants and the solvent and, as necessary, an organic phosphate ester compound and another component at the ratios shown in Table 3.

The content of the organic phosphate ester compound (D-1), the type and content of each nonionic surfactant (E), the type and content of each of the other components (G), the content of water (T-1), the nonvolatile concentration of each second treatment agent, and the content of each amine compound (E1) that is a nonionic surfactant in the nonvolatile matter are respectively indicated in the "Phosphate ester compound (D-1)" column, the "Nonionic surfactant (E)" column, the "Other component (G)" column, the "Water (T-1)" column, the "Nonvolatile concentration" column, and the "Content ratio of (E1) in nonvolatile matter" column of Table 3. The method for determining the nonvolatile concentration of each second treatment agent is the same as the method for determining the nonvolatile concentration of each first treatment agent.

Ion concentrations detected from the nonvolatile matter are indicated in the "Ion concentrations detected from nonvolatile matter" column of Table 3. The ion concentrations detected from the nonvolatile matter were measured by an ICP emission spectroscopy method and the method is the same as the ICP emission spectroscopy method for the first treatment agent with the exception of diluting with distilled water such that the nonvolatile concentration is 1%.

TABLE 3

| Second treatment agent | Organic phosphate ester compound (D-1) Ratio (%) | Nonionic surfactant (E) Other than amine compound (E1) Type | Ratio (%) | Amine compound (E1) Type | Ratio (%) | Other component (G) Type | Ratio (%) | Water (T-1) Ratio (%) | Nonvolatile concentration (%) |
|---|---|---|---|---|---|---|---|---|---|
| 2-1 | | Ea-10 | 29.9 | E1-2 | 39.7 | | | 0.5 | 99.5 |
| | | Ea-11 | 29.9 | | | | | | |
| 2-2 | | Ea-4 | 22.5 | E1-5 | 45.0 | | | 10 | 90 |
| | | Ea-5 | 22.5 | | | | | | |
| 2-3 | | | | E1-3 | 99.8 | | | 0.2 | 99.8 |
| 2-4 | | Ea-10 | 15 | E1-3 | 20.0 | | | 50 | 50 |
| | | Ea-11 | 15 | | | | | | |
| 2-5 | | Ea-8 | 27 | E1-3 | 36.0 | | | 10 | 90 |
| | | Ea-10 | 27 | | | | | | |
| 2-6 | | Ea-8 | 28.5 | E1-2 | 38.0 | | | 5 | 95 |
| | | Ea-10 | 28.5 | | | | | | |
| 2-7 | | Ea-8 | 25.5 | E1-8 | 34.0 | | | 15 | 85 |
| | | Ea-10 | 25.5 | | | | | | |
| 2-8 | | Ea-10 | 55.3 | E1-8 | 19.8 | | | 15 | 85 |
| | | | | E1-10 | 9.9 | | | | |
| 2-9 | | Ea-10 | 64.8 | E1-9 | 34.9 | | | 0.3 | 99.7 |
| 2-10 | | Ea-10 | 57.0 | E1-9 | 38.0 | | | 5 | 95 |
| 2-11 | | Ea-10 | 54.0 | E1-1 | 4.5 | | | 10 | 90 |
| | | | | E1-9 | 31.5 | | | | |
| 2-12 | | Ea-11 | 60.3 | E1-2 | 29.7 | | | 10 | 90 |
| 2-13 | | Ea-5 | 40.0 | E1-2 | 40.0 | | | 20 | 80 |
| 2-14 | | Ea-16 | 61.8 | E1-5 | 33.2 | | | 5 | 95 |
| 2-15 | | Ea-9 | 67.0 | E1-5 | 33.0 | | | | 100 |
| 2-16 | | Ea-6 | 26.4 | E1-1 | 27.2 | | | 20 | 80 |
| | | Eb-3 | 26.4 | | | | | | |
| 2-17 | | Ea-12 | 45 | E1-6 | 27.0 | | | 10 | 90 |
| | | Ea-15 | 18 | | | | | | |
| 2-18 | | Ea-14 | 50.2 | E1-10 | 26.3 | G-3 | 8.5 | 15 | 85 |
| 2-19 | | Ea-20 | 71.2 | E1-2 | 23.8 | | | 5 | 95 |
| 2-20 | | Ea-21 | 26.4 | E1-7 | 53.6 | | | 20 | 80 |
| 2-21 | | Ea-11 | 66.5 | E1-2 | 28.5 | | | 5 | 95 |
| 2-22 | | Ea-2 | 34 | E1-5 | 34.0 | | | 15 | 85 |
| | | Ea-14 | 17 | | | | | | |

TABLE 3-continued

| | | | | | | | | | |
|---|---|---|---|---|---|---|---|---|---|
| 2-23 | | Ea-1 | 27 | E1-5 | 45.0 | | | 10 | 90 |
| | | Ea-8 | 18 | | | | | | |
| 2-24 | | Ea-3 | 21.6 | E1-5 | 43.2 | G-1 | 3.6 | 10 | 90 |
| | | Ea-5 | 21.6 | | | | | | |
| 2-25 | 1.4 | Ea-4 | 23.3 | E1-2 | 46.5 | | | 5 | 95 |
| | | Ea-5 | 23.8 | | | | | | |
| 2-26 | | Ea-7 | 50.0 | | | | | 50 | 50 |
| 2-27 | | Eb-6 | 95.0 | | | | | 5 | 95 |
| 2-28 | | Ea-16 | 39 | | | | | | 100 |
| | | Ea-22 | 61 | | | | | | |
| 2-29 | | Ea-17 | 36.8 | | | | | 20 | 80 |
| | | Ea-19 | 43.2 | | | | | | |
| 2-30 | | Ea-18 | 100.0 | | | | | | 100 |
| 2-31 | | Ea-5 | 85.0 | | | | | 15 | 85 |
| 2-32 | | Ea-22 | 100.0 | | | | | | 100 |
| 2-33 | | Ea-10 | 42.5 | | | | | 15 | 85 |
| | | Ea-11 | 42.5 | | | | | | |
| 2-34 | | Ea-13 | 27 | | | | | 10 | 90 |
| | | Eb-1 | 63 | | | | | | |
| 2-35 | | Eb-5 | 100.0 | | | | | | 100 |
| 2-36 | | Eb-2 | 80.0 | | | | | 20 | 80 |
| 2-37 | | Ea-7 | 17 | | | | | 15 | 85 |
| | | Eb-4 | 68 | | | | | | |
| 2-38 | | Ea-23 | 81.0 | | | G-2 | 9 | 10 | 90 |
| 2-39 | | Ea-4 | 24.8 | E1-5 | 49.5 | | | 1 | 99 |
| | | Ea-5 | 24.7 | | | | | | |
| 2-40 | | Ea-7 | 49.5 | E1-5 | 49.5 | | | 1 | 99 |

| | Second treatment agent | Content ratio of (E1) in nonvolatile matter (%) | Ion concentrations detected from nonvolatile matter (ppm) | | | | | | Evaluation Storage stability |
|---|---|---|---|---|---|---|---|---|---|
| | | | Ca | K | Mg | Na | P | Si | |
| | 2-1 | 40 | 1 | 6 | 0.2 | 2 | 50 | 0 | ○○ |
| | 2-2 | 50 | 3 | 600 | 3 | 100 | 50 | 3 | ○○ |
| | 2-3 | 100 | 4 | 60 | 1 | 6 | 16300 | 0 | ○○ |
| | 2-4 | 40 | 3 | 450 | 0.5 | 150 | 6000 | 1 | ○○ |
| | 2-5 | 40 | 5 | 220 | 1 | 250 | 6500 | 0 | ○○ |
| | 2-6 | 40 | 4 | 150 | 0.6 | 200 | 12 | 0 | ○○ |
| | 2-7 | 40 | 2 | 100 | 0.5 | 150 | 8 | 2 | ○○ |
| | 2-8 | 35 | 3 | 750 | 1 | 100 | 14 | 0 | ○○ |
| | 2-9 | 35 | 5 | 550 | 0.9 | 10 | 40 | 0 | ○○ |
| | 2-10 | 40 | 4 | 650 | 0.5 | 20 | 20 | 4 | ○○ |
| | 2-11 | 40 | 4 | 600 | 1.2 | 25 | 25 | 0 | ○○ |
| | 2-12 | 33 | 3 | 13 | 0.6 | 6 | 1300 | 2 | ○○ |
| | 2-13 | 50 | 2 | 100 | 4 | 20 | 500 | 0 | ○○ |
| | 2-14 | 35 | 5 | 80 | 0.8 | 40 | 40 | 2 | ○○ |
| | 2-15 | 33 | 3 | 50 | 2 | 10 | 60 | 1 | ○○ |
| | 2-16 | 34 | 7 | 60 | 1 | 50 | 95 | 0 | ○○ |
| | 2-17 | 30 | 10 | 50 | 7 | 120 | 30 | 3 | ○○ |
| | 2-18 | 31 | 3 | 9700 | 1 | 400 | 35 | 0 | ○○ |
| | 2-19 | 25 | 10 | 30 | 1 | 90 | 300 | 0 | ○○ |
| | 2-20 | 67 | 2 | 60 | 5 | 150 | 150 | 5 | ○○ |
| | 2-21 | 30 | 9 | 200 | 1 | 200 | 90 | 2 | ○○ |
| | 2-22 | 40 | 8 | 90 | 8 | 90 | 240 | 1 | ○○ |
| | 2-23 | 50 | 5 | 250 | 6 | 60 | 430 | 1 | ○○ |
| | 2-24 | 48 | 5 | 70 | 8 | 5 | 300 | 3 | ○○ |
| | 2-25 | 49 | 3 | 110 | 6 | 210 | 270 | 1 | ○ |
| | 2-26 | 0 | 2 | 30 | 5 | 30 | 20 | 5 | ○○ |
| | 2-27 | 0 | 8 | 200 | 0.5 | 15 | 50 | 0 | ○○ |
| | 2-28 | 0 | 2 | 30 | 2 | 30 | 25 | 0 | ○○ |
| | 2-29 | 0 | 3 | 50 | 0.5 | 100 | 60 | 0 | ○○ |
| | 2-30 | 0 | 1 | 80 | 1 | 50 | 200 | 1 | ○○ |
| | 2-31 | 0 | 3 | 100 | 2 | 20 | 700 | 10 | ○○ |
| | 2-32 | 0 | 6 | 50 | 8 | 10 | 200 | 3 | ○○ |
| | 2-33 | 0 | 2 | 50 | 2 | 20 | 130 | 0 | ○○ |
| | 2-34 | 0 | 1 | 500 | 2 | 120 | 200 | 0 | ○○ |
| | 2-35 | 0 | 2 | 90 | 1 | 40 | 370 | 20 | ○○ |
| | 2-36 | 0 | 0 | 40 | 0.5 | 70 | 50 | 5 | ○○ |
| | 2-37 | 0 | 1 | 120 | 1 | 10 | 210 | 2 | ○○ |
| | 2-38 | 0 | 4 | 50 | 2 | 180 | 90 | 0 | ○○ |
| | 2-39 | 50 | 250 | 300 | 15 | 150 | 40 | 2 | ○ |
| | 2-40 | 50 | 30 | 60 | 200 | 90 | 50 | 3 | ○ |

Details of the organic phosphate ester compound (D-1), nonionic surfactants (E), and other components (G) indicated in Table 3 are as follows.

(Organic Phosphate Ester Compound (D-1))

Phosphate Ester Compound (A-1)

(Nonionic Surfactant (E))

Ea-1: (Polyoxyethylene) (polyoxypropylene) (m+n=7) decyl ether

Ea-2: Polyoxyethylene (6 moles) decyl ether

Ea-3: (Polyoxyethylene) (polyoxypropylene) (m+n=10) isodecyl ether

Ea-4: (Polyoxyethylene) (polyoxypropylene) (m+n=10) dodecyl ether

Ea-5: Polyoxyethylene (10 moles) dodecyl ether

Ea-6: Polyoxyethylene (15 moles) dodecyl ether

Ea-7: Polyoxyethylene (7 moles) dodecyl ether

Ea-8: Polyoxyethylene (9 moles) dodecyl ether

Ea-9: (Polyoxyethylene) (polyoxypropylene) (m+n=10) C12-13 alkyl ether

Ea-10: (Polyoxyethylene) (polyoxypropylene) (m+n=8) C12-13 alkyl ether

Ea-11: Polyoxyethylene (10 moles) C12-13 alkyl ether

Ea-12: Polyoxyethylene (15 moles) C12-13 alkyl ether

Ea-13: Polyoxyethylene (3 moles) C12-14 alkyl ether

Ea-14: (Polyoxyethylene) (polyoxypropylene) (m+n=8) tridecyl ether

Ea-15: Polyoxyethylene (15 moles) tridecyl ether

Ea-16: (Polyoxyethylene) (polyoxypropylene) (m+n=10) isotridecyl ether

Ea-17: (Polyoxyethylene) (polyoxypropylene) (m+n=12) C11-14 alkyl ether

Ea-18: Polyoxyethylene (10 moles) C11-14 alkyl ether

Ea-19: Polyoxyethylene (10 moles) octadecyl ether

Ea-20: Polyoxyethylene (10 moles) oleyl ether

Ea-21: Polyoxyethylene (5 moles) oleyl ether

Ea-22: Polyoxyethylene (8 moles) oleyl ether

Ea-23: Polyoxyethylene (20 moles) oleyl ether

Eb-1: (Polyoxyethylene) (polyoxypropylene) (m+n=20) hardened castor oil

Eb-2: Polyoxyethylene (10 moles) lauryl ester

Eb-3: Polyoxyethylene (12 moles) lauryl ester

Eb-4: Polyoxyethylene (10 moles) oleyl ester

Eb-5: Polyoxyethylene (10 moles) palm fatty acid ester

Eb-6: Polyoxyethylene (7 moles) palm fatty acid ester (Amine Compound (E1) as Nonionic Surfactant)

E1-1: Polyoxyethylene (4 moles) dodecylamine

E1-2: Polyoxyethylene (10 moles) dodecylamine

E1-3: Salt of polyoxyethylene (10 moles) dodecylamine and phosphoric acid

E1-4: Polyoxyethylene (12 moles) dodecylamine

E1-5: Polyoxyethylene (15 moles) dodecylamine

E1-6: Polyoxyethylene (5 moles) octadecylamine

E1-7: Polyoxyethylene (10 moles) octadecylamine

E1-8: Polyoxyethylene (10 moles) palm amine

E1-9: Polyoxyethylene (12 moles) palm amine

E1-10: Polyoxyethylene (15 moles) palm amine (Other Component (G))

G-1: Octyl alcohol

G-2: Propylene glycol

G-3: Potassium oleate

Experimental Part 3 (Preparation of Synthetic Fiber Treatment Agent)

A first treatment agent obtained in Experimental Part 1 and a second treatment agent obtained in Experimental Part 2 were mixed at ratios shown in Table 4 or 5 by a method described below to prepare each synthetic fiber treatment agent of emulsion form.

Example 1

First, 40 g of cation exchanged water are weighed out and stirred for 3 minutes using a propeller stirrer at 500 rpm in a water bath at 80° C. 6.25 g (2.5 g as nonvolatile matter) of the first treatment agent 1-1 are dripped into the beaker with a dropper and stirred for 5 minutes.

Next, 2.51 g (2.5 g as nonvolatile matter) of the second treatment agent are dripped in with a dropper and stirred for 5 minutes.

Here, the blending ratio (%) of the first treatment agent is: mass of first treatment agent/(mass of first treatment agent+mass of second treatment agent)×100=71.3%. The blending ratio (%) of the second treatment agent is: mass of second treatment agent/(mass of first treatment agent+mass of second treatment agent)×100=28.7%.

The beaker is taken out from the water bath and while stirring at 500 rpm at room temperature, 50 g of 25° C. cation exchanged water are added. After stirring for 3 minutes, cation exchanged water is added such that the total weight of the aqueous liquid is 100 g. The aqueous liquid obtained by stirring for 1 minute was used as the 5% emulsion (nonvolatile content: 5%) of Example 1.

As each of Examples 2 to 79, a 5% emulsion as a synthetic fiber treatment agent was prepared as in Example 1 by mixing a first treatment agent and a second treatment agent at ratios shown in Table 4 or 5.

Comparative Example 1

80 g of cation exchanged water are weighed out and stirred for 3 minutes using a propeller stirrer at 500 rpm in a water bath at 80° C. As the first treatment agent 1-1, 5 g as nonvolatile matter (12.5 g as the first treatment agent) are dripped into the beaker with a dropper and stirred for 5 minutes. After stirring, cation exchanged water is added such that the total weight of the aqueous liquid is 100 g. The aqueous liquid obtained by stirring for 1 minute was used as the 5% emulsion (nonvolatile content: 5%) of Comparative Example 1.

As each of Comparative Examples 2 to 6, a 5% emulsion was prepared as in Comparative Example 1 by mixing a first treatment agent or a second treatment agent at ratio shown in Table 5.

The type and content of each first treatment agent and the type and content of each second treatment agent are respectively shown in the "First treatment agent" column and the "Second treatment agent" column of Table 4 or 5.

TABLE 4

| Synthetic fiber treatment agent | Aqueous liquid of synthetic fiber treatment agent: First treatment agent: Type of first treatment agent | Blending ratio with respect to nonvolatile matter (%) | Blending ratio as first treatment agent (%) | Second treatment agent: Type of second treatment agent | Blending ratio with respect to nonvolatile matter (%) | Blending ratio as second treatment agent (%) | Evaluation of aqueous liquid of synthetic fiber treatment agent: Emulsion stability | Yarn spinning properties: Card passing property | Scum suppression | Antistatic property |
|---|---|---|---|---|---|---|---|---|---|---|
| Example 1 | 1-1 | 50 | 71.3 | 2-1 | 50 | 28.7 | ○○○ | ○○ | ○○ | ○○ |
| Example 2 | 1-2 | 70 | 84.0 | 2-2 | 30 | 16.0 | ○○○ | ○○ | ○○ | ○○ |
| Example 3 | 1-3 | 60 | 78.9 | 2-3 | 40 | 21.1 | ○○○ | ○○ | ○○ | ○○ |
| Example 4 | 1-4 | 60 | 65.2 | 2-4 | 40 | 34.8 | ○○○ | ○○ | ○○ | ○○ |
| Example 5 | 1-5 | 60 | 77.1 | 2-5 | 40 | 22.9 | ○○○ | ○○ | ○○ | ○○ |
| Example 6 | 1-6 | 60 | 78.1 | 2-6 | 40 | 21.9 | ○○○ | ○○ | ○○ | ○○ |
| Example 7 | 1-7 | 60 | 76.1 | 2-7 | 40 | 23.9 | ○○○ | ○○ | ○○ | ○○ |
| Example 8 | 1-8 | 60 | 76.1 | 2-8 | 40 | 23.9 | ○○○ | ○○ | ○○ | ○○ |
| Example 9 | 1-9 | 60 | 78.9 | 2-9 | 40 | 21.1 | ○○○ | ○○ | ○○ | ○○ |
| Example 10 | 1-10 | 60 | 78.1 | 2-10 | 40 | 21.9 | ○○○ | ○○ | ○○ | ○○ |
| Example 11 | 1-11 | 60 | 77.1 | 2-11 | 40 | 22.9 | ○○○ | ○○ | ○○ | ○○ |
| Example 12 | 1-16 | 60 | 77.1 | 2-12 | 40 | 22.9 | ○○○ | ○○ | ○○ | ○○ |
| Example 13 | 1-17 | 60 | 75.0 | 2-13 | 40 | 25.0 | ○○○ | ○○ | ○○ | ○○ |
| Example 14 | 1-18 | 60 | 78.1 | 2-14 | 40 | 21.9 | ○○○ | ○○ | ○○ | ○○ |
| Example 15 | 1-19 | 60 | 78.9 | 2-15 | 40 | 21.1 | ○○○ | ○○ | ○○ | ○○ |
| Example 16 | 1-20 | 50 | 66.7 | 2-16 | 50 | 33.3 | ○○○ | ○○ | ○○ | ○○ |
| Example 17 | 1-21 | 50 | 69.2 | 2-17 | 50 | 30.8 | ○○○ | ○○ | ○○ | ○○ |
| Example 18 | 1-22 | 60 | 76.1 | 2-18 | 40 | 23.9 | ○○○ | ○○ | ○○ | ○○ |
| Example 19 | 1-23 | 60 | 78.1 | 2-19 | 40 | 21.9 | ○○○ | ○○ | ○○ | ○○ |
| Example 20 | 1-24 | 60 | 75.0 | 2-20 | 40 | 25.0 | ○○○ | ○○ | ○○ | ○○ |
| Example 21 | 1-27 | 60 | 78.1 | 2-21 | 40 | 21.9 | ○○○ | ○○ | ○○ | ○○ |
| Example 22 | 1-28 | 60 | 76.1 | 2-22 | 40 | 23.9 | ○○○ | ○○ | ○○ | ○○ |
| Example 23 | 1-29 | 60 | 77.1 | 2-23 | 40 | 22.9 | ○○○ | ○○ | ○○ | ○○ |
| Example 24 | 1-30 | 60 | 75.0 | 2-24 | 40 | 25.0 | ○○○ | ○○ | ○○ | ○○ |
| Example 25 | 1-31 | 60 | 73.1 | 2-1 | 40 | 26.9 | ○○○ | ○○ | ○○ | ○○ |
| Example 26 | 1-32 | 60 | 77.1 | 2-2 | 40 | 22.9 | ○○○ | ○○ | ○○ | ○○ |
| Example 27 | 1-33 | 60 | 81.1 | 2-3 | 40 | 18.9 | ○○○ | ○○ | ○○ | ○○ |
| Example 28 | 1-34 | 70 | 74.5 | 2-4 | 30 | 25.5 | ○○○ | ○○ | ○○ | ○○ |
| Example 29 | 1-35 | 70 | 82.4 | 2-5 | 30 | 17.6 | ○○○ | ○○ | ○○ | ○○ |
| Example 30 | 1-36 | 70 | 80.1 | 2-6 | 30 | 19.9 | ○○○ | ○○ | ○○ | ○○ |
| Example 31 | 1-37 | 60 | 76.1 | 2-7 | 40 | 23.9 | ○○○ | ○○ | ○○ | ○○ |
| Example 32 | 1-38 | 60 | 76.1 | 2-8 | 40 | 23.9 | ○○○ | ○○ | ○○ | ○○ |
| Example 33 | 1-39 | 60 | 78.9 | 2-9 | 40 | 21.1 | ○○○ | ○○ | ○○ | ○○ |
| Example 34 | 1-1 | 80 | 90.5 | 2-10 | 20 | 9.5 | ○○○ | ○○ | ○○ | ○○ |
| Example 35 | 1-2 | 50 | 69.2 | 2-11 | 50 | 30.8 | ○○○ | ○○ | ○○ | ○○ |
| Example 36 | 1-3 | 40 | 60.0 | 2-12 | 60 | 40.0 | ○○○ | ○○ | ○○ | ○○ |
| Example 37 | 1-4 | 40 | 57.1 | 2-13 | 60 | 42.9 | ○○○ | ○○ | ○○ | ○○ |
| Example 38 | 1-25 | 60 | 78.9 | 2-1 | 40 | 21.1 | ○○○ | ○○ | ○○ | ○○ |
| Example 39 | 1-26 | 60 | 81.8 | 2-2 | 40 | 18.2 | ○○○ | ○○ | ○○ | ○○ |
| Example 40 | 1-40 | 70 | 85.3 | 2-3 | 30 | 14.7 | ○○○ | ○○ | ○○ | ○○ |
| Example 41 | 1-41 | 70 | 74.5 | 2-4 | 30 | 25.5 | ○○○ | ○○ | ○○ | ○○ |
| Example 42 | 1-42 | 70 | 84.0 | 2-5 | 30 | 16.0 | ○○○ | ○○ | ○○ | ○○ |
| Example 43 | 1-43 | 60 | 78.1 | 2-6 | 40 | 21.9 | ○○○ | ○○ | ○○ | ○○ |
| Example 44 | 1-44 | 60 | 76.1 | 2-7 | 40 | 23.9 | ○○○ | ○○ | ○○ | ○○ |
| Example 45 | 1-45 | 60 | 76.1 | 2-8 | 40 | 23.9 | ○○○ | ○○ | ○○ | ○○ |
| Example 46 | 1-46 | 60 | 78.9 | 2-9 | 40 | 21.1 | ○○○ | ○○ | ○○ | ○○ |
| Example 47 | 1-47 | 60 | 78.1 | 2-10 | 40 | 21.9 | ○○○ | ○○ | ○○ | ○○ |
| Example 48 | 1-48 | 60 | 77.1 | 2-11 | 40 | 22.9 | ○○○ | ○○ | ○○ | ○○ |
| Example 49 | 1-49 | 60 | 75.0 | 2-12 | 40 | 25.0 | ○○○ | ○○ | ○○ | ○○ |
| Example 50 | 1-50 | 60 | 68.6 | 2-13 | 40 | 31.4 | ○○○ | ○○ | ○○ | ○○ |
| Example 51 | 1-51 | 60 | 78.1 | 2-14 | 40 | 21.9 | ○○○ | ○○ | ○○ | ○○ |
| Example 52 | 1-1 | 60 | 78.1 | 2-25 | 40 | 21.9 | ○○○ | ○○ | ○○ | ○○ |

TABLE 5

| Synthetic fiber treatment agent | Aqueous liquid of synthetic fiber treatment agent: First treatment agent: Type of first treatment agent | Blending ratio with respect to nonvolatile matter (%) | Blending ratio as first treatment agent (%) | Second treatment agent: Type of second treatment agent | Blending ratio with respect to nonvolatile matter (%) | Blending ratio as second treatment agent (%) | Evaluation of aqueous liquid of synthetic fiber treatment agent: Emulsion stability | Yarn spinning properties: Card passing property | Scum suppression | Antistatic property |
|---|---|---|---|---|---|---|---|---|---|---|
| Example 53 | 1-1 | 60 | 65.2 | 2-26 | 40 | 34.8 | ○○ | ○○ | ○○ | ○○ |
| Example 54 | 1-1 | 60 | 78.1 | 2-27 | 40 | 21.9 | ○○ | ○○ | ○○ | ○○ |
| Example 55 | 1-1 | 70 | 85.4 | 2-28 | 30 | 14.6 | ○○ | ○○ | ○○ | ○○ |
| Example 56 | 1-1 | 70 | 82.4 | 2-29 | 30 | 17.6 | ○○ | ○○ | ○○ | ○○ |
| Example 57 | 1-1 | 70 | 85.4 | 2-30 | 30 | 14.6 | ○○ | ○○ | ○○ | ○○ |
| Example 58 | 1-2 | 70 | 83.2 | 2-31 | 30 | 16.8 | ○○ | ○○ | ○○ | ○○ |
| Example 59 | 1-2 | 70 | 85.4 | 2-32 | 30 | 14.6 | ○○ | ○○ | ○○ | ○○ |
| Example 60 | 1-2 | 70 | 83.2 | 2-33 | 30 | 16.8 | ○○ | ○○ | ○○ | ○○ |
| Example 61 | 1-2 | 60 | 77.1 | 2-34 | 40 | 22.9 | ○○ | ○○ | ○○ | ○○ |
| Example 62 | 1-1 | 60 | 78.9 | 2-35 | 40 | 21.1 | ○○ | ○○ | ○○ | ○○ |
| Example 63 | 1-1 | 60 | 75.0 | 2-36 | 40 | 25.0 | ○○ | ○○ | ○○ | ○○ |
| Example 64 | 1-1 | 60 | 76.1 | 2-37 | 40 | 23.9 | ○○ | ○○ | ○○ | ○○ |
| Example 65 | 1-1 | 60 | 77.1 | 2-38 | 40 | 22.9 | ○○ | ○○ | ○○ | ○○ |
| Example 66 | 1-1 | 30 | 51.6 | 2-1 | 70 | 48.4 | ○○○ | ○○ | ○○ | ○ |
| Example 67 | 1-2 | 20 | 36.0 | 2-2 | 80 | 64.0 | ○○○ | ○○ | ○○ | ○ |
| Example 68 | 1-3 | 25 | 45.4 | 2-3 | 75 | 54.6 | ○○○ | ○○ | ○○ | ○ |
| Example 69 | 1-4 | 30 | 34.9 | 2-4 | 70 | 65.1 | ○○○ | ○○ | ○○ | ○ |
| Example 70 | 1-5 | 30 | 49.1 | 2-5 | 70 | 50.9 | ○○○ | ○○ | ○○ | ○ |
| Example 71 | 1-6 | 30 | 50.4 | 2-6 | 70 | 49.6 | ○○○ | ○○ | ○○ | ○ |
| Example 72 | 1-13 | 50 | 75.8 | 2-13 | 50 | 24.2 | ○○ | ○○ | ○ | ○○ |
| Example 73 | 1-15 | 50 | 71.4 | 2-15 | 50 | 28.6 | ○○ | ○○ | ○ | ○○ |
| Example 74 | 1-12 | 60 | 77.1 | 2-12 | 40 | 22.9 | ○○ | ○ | ○ | ○○ |
| Example 75 | 1-14 | 50 | 70.4 | 2-14 | 50 | 29.6 | ○○ | ○ | ○ | ○○ |
| Example 76 | 1-52 | 50 | 71.4 | 2-3 | 50 | 28.6 | ○ | ○ | ○ | ○ |
| Example 77 | 1-53 | 50 | 55.6 | 2-4 | 50 | 44.4 | ○ | ○ | ○ | ○ |
| Example 78 | 1-3 | 50 | 71.2 | 2-39 | 50 | 28.8 | ○ | ○ | ○ | ○ |
| Example 79 | 1-4 | 50 | 71.2 | 2-40 | 50 | 28.8 | ○ | ○ | ○ | ○ |
| Comparative Example 1 | 1-1 | 100 | 100.0 | — | | | ○ | ○ | ○ | x |
| Comparative Example 2 | — | | | 2-1 | 100 | 100.0 | ○○○ | x | x | x |
| Comparative Example 3 | 1-52 | 100 | 100.0 | — | | | ○ | ○ | ○ | x |
| Comparative Example 4 | 1-53 | 100 | 100.0 | — | | | ○ | ○ | ○ | x |
| Comparative Example 5 | — | | | 2-39 | 100 | 100.0 | ○○○ | x | x | x |
| Comparative Example 6 | — | | | 2-40 | 100 | 100.0 | ○○○ | x | x | × |

TABLE 6

| | Phosphate compound (A) | | Monohydric aliphatic alcohol (B) | | Nonionic surfactant (Ca-1) | Other component (F) | | Organic phosphate ester compound (D-1) | Nonionic surfactant (E): Other than amine compound (E1) | | Amine compound (E1) | |
|---|---|---|---|---|---|---|---|---|---|---|---|---|
| | Type | Ratio (%) | Type | Ratio (%) | Ratio (%) | Type | Ratio (%) | Ratio (%) | Type | Ratio (%) | Type | Ratio (%) |
| Comparative Example 7 | A-1 | 4.85 | Ba-1 | 0.15 | | | | | Ea-10<br>Ea-11 | 28.55<br>28.55 | E1-2 | 37.90 |
| Comparative Example 8 | A-1 | 9.70 | Ba-1 | 0.30 | | | | | Ea-10<br>Ea-11 | 27.045<br>27.045 | E1-2 | 35.91 |
| Comparative Example 9 | A-1 | 19.40 | Ba-1 | 0.60 | | | | | Ea-10<br>Ea-11 | 24.04<br>24.04 | E1-2 | 31.92 |
| Comparative Example 10 | A-1 | 29.10 | Ba-1 | 0.90 | | | | | Ea-10<br>Ea-11 | 21.035<br>21.035 | E1-2 | 27.93 |
| Comparative Example 11 | A-1 | 38.80 | Ba-1 | 1.20 | | | | | Ea-10<br>Ea-11 | 18.03<br>18.03 | E1-2 | 23.94 |
| Comparative Example 12 | A-1 | 48.50 | Ba-1 | 1.50 | | | | | Ea-10<br>Ea-11 | 15.025<br>15.025 | E1-2 | 19.95 |

TABLE 6-continued

| | | | | | | | | | | | | | |
|---|---|---|---|---|---|---|---|---|---|---|---|---|---|
| Comparative Example 13 | A-1 | 58.20 | Ba-1 | 1.80 | | | | | Ea-10<br>Ea-11 | 12.02<br>12.02 | E1-2 | 15.96 |
| Comparative Example 14 | A-1 | 67.90 | Ba-1 | 2.10 | | | | | Ea-10<br>Ea-11 | 9.015<br>9.015 | E1-2 | 11.97 |
| Comparative Example 15 | A-1 | 77.60 | Ba-1 | 2.40 | | | | | Ea-10<br>Ea-11 | 6.01<br>6.01 | E1-2 | 7.98 |
| Comparative Example 16 | A-1 | 87.30 | Ba-1 | 2.70 | | | | | Ea-10<br>Ea-11 | 3.005<br>3.005 | E1-2 | 3.99 |
| Comparative Example 17 | A-1 | 92.15 | Ba-1 | 2.85 | | | | | Ea-10<br>Ea-11 | 1.5025<br>1.5025 | E1-2 | 1.995 |
| Comparative Example 18 | A-1 | 48.50 | Ba-1 | 1.50 | | | | | Ea-4<br>Ea-5 | 12.5<br>12.5 | E1-5 | 25.00 |
| Comparative Example 19 | A-1 | 48.50 | Ba-1 | 1.50 | | | | | | | E1-3 | 50.00 |
| Comparative Example 20 | A-1 | 48.50 | Ba-1 | 1.50 | | | | | Ea-10<br>Ea-11 | 15.0<br>15.0 | E1-3 | 20.00 |
| Comparative Example 21 | A-1 | 48.50 | Ba-1 | 1.50 | | | | | Ea-8<br>Ea-10 | 15.0<br>15.0 | E1-3 | 20.00 |
| Comparative Example 22 | A-1 | 48.50 | Ba-1 | 1.50 | | | | | Ea-8<br>Ea-10 | 15.0<br>15.0 | E1-2 | 20.00 |
| Comparative Example 23 | A-1 | 48.50 | Ba-1 | 1.50 | | | | | Ea-8<br>Ea-10 | 15.0<br>15.0 | E1-8 | 20.00 |
| Comparative Example 24 | A-1 | 48.50 | Ba-1 | 1.50 | | | | | Ea-10 | 32.5 | E1-8<br>E1-10 | 11.67<br>5.83 |
| Comparative Example 25 | A-1 | 48.50 | Ba-1 | 1.50 | | | | | Ea-10 | 32.5 | E1-9 | 17.50 |
| Comparative Example 26 | A-1 | 48.50 | Ba-1 | 1.50 | | | | | Ea-10 | 30.0 | E1-9 | 20.00 |
| Comparative Example 27 | A-1 | 48.50 | Ba-1 | 1.50 | | | | | Ea-10 | 30.0 | E1-1<br>E1-9 | 2.5<br>17.5 |
| Comparative Example 28 | A-1 | 48.50 | Ba-1 | 1.50 | | | | | Ea-11 | 33.5 | E1-2 | 16.50 |
| Comparative Example 29 | A-1 | 48.50 | Ba-1 | 1.50 | | | | | Ea-14 | 29.53 | E1-10 | 15.47 |
| Comparative Example 30 | A-1 | 48.50 | Ba-1 | 1.50 | | | | | Ea-3<br>Ea-5 | 12<br>12 | E1-5 | 24.00 |
| Comparative Example 31 | A-1 | 48.50 | Ba-1 | 1.50 | | | | 0.737 | Ea-4<br>Ea-5 | 12.263<br>12.526 | E1-2 | 24.47<br>4 |
| Comparative Example 32 | A-2 | 45.00 | Ba-1 | 5.00 | | | | | Ea-10<br>Ea-11 | 15.025<br>15.025 | E1-2 | 19.95 |
| Comparative Example 33 | A-3 | 47.50 | Ba-1 | 2.50 | | | | | Ea-10<br>Ea-11 | 15.025<br>15.025 | E1-2 | 19.95 |
| Comparative Example 34 | A-4 | 48.00 | Ba-1 | 2.00 | | | | | Ea-10<br>Ea-11 | 15.025<br>15.025 | E1-2 | 19.95 |
| Comparative Example 35 | A-5 | 47.00 | Ba-1 | 3.00 | | | | | Ea-10<br>Ea-11 | 15.025<br>15.025 | E1-2 | 19.95 |
| Comparative Example 36 | A-6 | 46.50 | Ba-1 | 3.50 | | | | | Ea-10<br>Ea-11 | 15.025<br>15.025 | E1-2 | 19.95 |
| Comparative Example 37 | A-1 | 40.50 | Ba-1 | 4.50 | 0.75 | Fb-1<br>Fc-2 | 3.5<br>0.75 | | Ea-10<br>Ea-11 | 15.025<br>15.025 | E1-2 | 19.95 |
| Comparative Example 38 | A-1 | 40.50 | Ba-1 | 4.50 | 0.75 | Fb-2<br>Fc-1 | 3.5<br>0.75 | | Ea-10<br>Ea-11 | 15.025<br>15.025 | E1-2 | 19.95 |
| Comparative Example 39 | A-17 | 46.00 | Ba-1<br>Ba-2 | 2.5<br>1.5 | | | | | Ea-10<br>Ea-11 | 15.025<br>15.025 | E1-2 | 19.95 |
| Comparative Example 40 | A-18 | 48.50 | Ba-1<br>Ba-2 | 0.5<br>1.0 | | | | | Ea-10<br>Ea-11 | 15.025<br>15.025 | E1-2 | 19.95 |
| Comparative Example 41 | A-19 | 48.00 | Ba-1<br>Ba-2 | 1.5<br>0.5 | | | | | Ea-10<br>Ea-11 | 15.025<br>15.025 | E1-2 | 19.95 |
| Comparative Example 42 | A-20 | 46.00 | Ba-2 | 4.00 | | | | | Ea-10<br>Ea-11 | 15.025<br>15.025 | E1-2 | 19.95 |
| Comparative Example 43 | A-21 | 48.00 | Ba-2 | 2.00 | | | | | Ea-10<br>Ea-11 | 15.025<br>15.025 | E1-2 | 19.95 |
| Comparative Example 44 | A-22 | 47.50 | Ba-2 | 2.50 | | | | | Ea-10<br>Ea-11 | 15.025<br>15.025 | E1-2 | 19.95 |

| | Other component (G) | | Nonvolatile | | | Yarn spinning properties | | |
|---|---|---|---|---|---|---|---|---|
| | Type | Ratio (%) | concentration (%) | Storage stability | Emulsion stability | Card passing property | Scum suppression | Antistatic property |
| Comparative Example 7 | | | 92.61 | xxx | —* | —* | —* | —* |
| Comparative Example 8 | | | 86.62 | xxx | —* | —* | —* | —* |
| Comparative Example 9 | | | 76.69 | xxx | —* | —* | —* | —* |
| Comparative Example 10 | | | 68.80 | xxx | —* | —* | —* | —* |

TABLE 6-continued

| | | | | | | | | |
|---|---|---|---|---|---|---|---|---|
| Comparative Example 11 | | | 62.38 | xx | —* | —* | —* | —* |
| Comparative Example 12 | | | 57.06 | xx | —* | —* | —* | —* |
| Comparative Example 13 | | | 52.58 | xx | —* | —* | —* | —* |
| Comparative Example 14 | | | 48.74 | xx | —* | —* | —* | —* |
| Comparative Example 15 | | | 45.43 | xx | —* | —* | —* | —* |
| Comparative Example 16 | | | 42.54 | xx | —* | —* | —* | —* |
| Comparative Example 17 | | | 41.23 | xx | —* | —* | —* | —* |
| Comparative Example 18 | | | 55.38 | xx | —* | —* | —* | —* |
| Comparative Example 19 | | | 57.11 | xx | —* | —* | —* | —* |
| Comparative Example 20 | | | 44.44 | xx | —* | —* | —* | —* |
| Comparative Example 21 | | | 55.38 | x | —* | —* | —* | —* |
| Comparative Example 22 | | | 56.30 | xx | —* | —* | —* | —* |
| Comparative Example 23 | | | 54.40 | x | —* | —* | —* | —* |
| Comparative Example 24 | | | 54.40 | xx | —* | —* | —* | —* |
| Comparative Example 25 | | | 57.09 | xx | —* | —* | —* | —* |
| Comparative Example 26 | | | 56.30 | xx | —* | —* | —* | —* |
| Comparative Example 27 | | | 55.38 | xx | —* | —* | —* | —* |
| Comparative Example 28 | | | 55.38 | xx | —* | —* | —* | —* |
| Comparative Example 29 | G-3 | 5.00 | 54.40 | x | —* | —* | —* | —* |
| Comparative Example 30 | G-1 | 2.00 | 55.38 | xx | —* | —* | —* | —* |
| Comparative Example 31 | | | 56.30 | xx | —* | —* | —* | —* |
| Comparative Example 32 | | | 57.06 | xxx | —* | —* | —* | —* |
| Comparative Example 33 | | | 57.06 | xx | —* | —* | —* | —* |
| Comparative Example 34 | | | 57.06 | xx | —* | —* | —* | —* |
| Comparative Example 35 | | | 57.06 | xx | —* | —* | —* | —* |
| Comparative Example 36 | | | 57.06 | xx | —* | —* | —* | —* |
| Comparative Example 37 | | | 57.06 | x | —* | —* | —* | —* |
| Comparative Example 38 | | | 46.10 | xx | —* | —* | —* | —* |
| Comparative Example 39 | | | 57.06 | xx | —* | —* | —* | —* |
| Comparative Example 40 | | | 57.06 | xx | —* | —* | —* | —* |
| Comparative Example 41 | | | 57.06 | xx | —* | —* | —* | —* |
| Comparative Example 42 | | | 61.97 | xx | —* | —* | —* | —* |
| Comparative Example 43 | | | 70.84 | xx | —* | —* | —* | —* |
| Comparative Example 44 | | | 57.08 | xx | —* | —* | —* | —* |

*Evaluation not performed due to poor storage stability.

Experimental Part 4 (Evaluation of Storage Stability)

150 g of each of the first treatment agents and the second treatment agents shown in Tables 2 and 3 were placed in a transparent plastic bottle of 200 mL. The viscosity at 30° C. was measured with the B type viscometer. Leaving for 1 month was performed in each of incubators at 25° C. and 50° C. With the day of start of leaving as the 0th day, observation of appearance was performed on the 1st, 3rd, 5th, 7th, 14th, 21st, and 28th day. The storage stability was evaluated based on the criteria described below. The results are shown in the "Storage stability" columns of Tables 2 and 3.

In regard to each treatment agent of Comparative Examples 7 to 44, preparation was performed by mixing respective components in a beaker in accordance with the ratios indicated in Table 6 and such that the total of the nonvolatile components and the solvent is 200 g. After mixing, stirring with a glass rod was performed until uniform. After stirring, 150 g of the mixture were placed in a 200 mL transparent plastic bottle. The viscosity at 30° C. was measured with the B type viscometer. Leaving for 1 month was performed in each of incubators at 25° C. and 50° C. and with the day of start of leaving as the 0th day, observation of appearance was performed on the 1st, 3rd, 5th, 7th, 14th, 21st, and 28th day. The storage stability was evaluated based on the criteria described below. The results are shown in the "Storage stability" column of Table 6. In Table 6, for the treatment agents of Comparative Examples 7 to 44, the types of the respective components and the contents of the respective components when the nonvolatile concentration is taken as 100% are shown in the columns of the respective components and the nonvolatile concentrations in the treatment agents are shown in the "Nonvolatile concentration" column.

Evaluation Criteria of Storage Stability

- ○○ (excellent): At both 25° C. and 50° C., thickening was of the below-described thickening level 1 and there was no separation at 1 month.
- ○ (good): At 25° C., thickening was of the below-described thickening level 1 or thickening level 2 and there was no separation up to the 28th day, however at 50° C., thickening was of the below-described thickening level 1 or there was separation between the 8th day and the 28th day.
- Δ (acceptable): At 50° C., the thickening was of the below-described thickening level 2 or there was separation by the 7th day.
- x (somewhat poor): At 25° C., thickening was of the below-described thickening level 1 or there was separation by the 8th day to 28th day and at 50° C. thickening was of the below-described thickening level 1 or there was separation by the 7th day.
- xx (poor): Thickening was of the below-described thickening level 1 or there was separation by the 7th day at 25° C. or by the 3rd day at 50° C.
- xxx (extremely poor): Thickening was of the below-described thickening level 1 or there was separation by the 3rd day at 25° C.

Here, "by the _th" day includes the case where thickening or separation was observed on the _th day.

Thickening level 1 was deemed to correspond to a case where there is no change in liquid surface (liquid does not flow) up to 5 minutes after tilting the plastic bottle by 90°.

Thickening level 2 was deemed to correspond to a case where there is a change in liquid surface (liquid begins to flow) when the plastic bottle is tilted by 90° and to correspond to a case where the viscosity as measured by the B type viscometer increased to 1.5 times or more of that before the storage stability evaluation.

Experimental Part 5 (Evaluation of Emulsion Stability)

With each of the 5% emulsions obtained in Experimental Part 3, 100 g were placed in a 100 mL conical bottom sedimentation tube (manufactured by Sansyo Co., Ltd.). Leaving in a room at 25° C. was performed and a settling volume was checked after the elapse of 24 hours. The emulsion stability was evaluated based on the criteria described below. The results are shown in the "Emulsion stability" columns of Tables 4 and 5. As indicated in Table 6, the evaluation of emulsion stability was not performed for Comparative Examples 7 to 44 because the storage stabilities were evaluated to be poor.

Evaluation Criteria of Emulsion Stability

- ○○○ (excellent): The settling volume was less than 0.1 mL.
- ○○ (good): The settling volume was not less than 0.1 mL and not more than 0.3 mL.
- ○ (acceptable): The settling volume was more than 0.3 mL but not more than 0.5 mL.
- x (poor): The settling volume was more than 0.5 mL.

Experimental Part 6 (Adhesion of Treatment Agent to Polyester Staple Fibers)

Each of the 5% emulsions prepared in Experimental Part 3 was used. The prepared emulsion was adhered by a spraying method to semi dull polyester staple fibers with a fineness of $1.3\times10^{-4}$ g/m (1.2 denier) and a fiber length 38 mm obtained by a drafts making process such that the amount adhered as nonvolatile matter was 0.15%. After then drying for 2 hours with a hot air dryer at 80° C., overnight conditioning under an atmosphere of 25° C. and 40% RH was performed to obtain treated polyester staple fibers. As indicated in Table 6, the evaluations of yarn spinning properties (or card passing property, scum suppression, and antistatic property) were not performed for Comparative Examples 7 to 44 because the storage stabilities were evaluated to be poor.

Experimental Part 7 (Evaluation of Card Passing Property)

20 g of the treated staple fibers obtained in Experimental Part 6 were conditioned for 24 hours in a thermostatic chamber of 20° C. and 65% RH and thereafter fed to a miniature carding machine. A ratio of the amount discharged with respect to the loading amount was calculated and evaluated according to the following evaluation criteria. The results are shown in the "Card passing property" columns of Tables 4 and 5.

Evaluation Criteria of Card Passing Property

- ○○ (good): The discharged amount was not less than 90%.
- ○ (acceptable): The discharged amount was not less than 80% but less than 90%.
- x (poor): The discharged amount was less than 80%.

Experimental Part 8 (Evaluation of Scum Suppression)

100 g of the treated staple fibers obtained in Experimental Part 6 were conditioned for 24 hours in a thermostatic chamber of 20° C. and 65% RH and thereafter fed to a miniature carding machine. The amount of scum deposited on a cylinder portion after the test was judged. The results are shown in the "Scum suppression" columns of Tables 4 and 5.

Evaluation of Scum Suppression

- ○○ (good): No scum was deposited at all.
- ○ (acceptable): The scum deposition amount was less than 2% of the cylinder surface area.
- x (poor): The scum deposition amount was not less than 2% of the cylinder surface area.

Experimental Part 9 (Evaluation of Antistatic Property)

20 g of the treated staple fibers obtained in Experimental Part 6 were used and fed to a miniature carding machine under an atmosphere of 25° C.×40% RH. A digital electrostatic potentiometer was used to measure static electricity of the spun card from a position separated by 1 cm from the card web and the antistatic property was determined according to the following criteria. The results are shown in the "Antistatic property" columns of Tables 4 and 5.

Evaluation Criteria of Antistatic Property

○○ (good): The static electricity generation amount was less than 0.3 kV.

○ (acceptable): The static electricity generation amount was not less than 0.3 kV but less than 0.6 kV.

x (poor): The static electricity generation amount was not less than 0.6 kV.

The synthetic fiber treatment agents of Comparative Examples 7 to 44 are each prepared by mixing a phosphate compound (A) and a nonionic surfactant (E) in advance at blending ratios outside the ranges of the present invention. The synthetic fiber treatment agents of Comparative Examples 7 to 44 were all confirmed to be poor in storage stability. On the other hand, by the first treatment agents according to the present invention, the storage stability can be improved as is clear from the evaluation results of storage stability shown in Table 2. Also, a fiber imparted with a synthetic fiber treatment agent constituted by including such a first treatment agent is improved in card passing property, improved in scum suppression effect and antistatic property, and can sufficiently exhibit various functions. In addition, it has been confirmed that the same effects, that is, the effects of improving the card passing property, antistatic property, etc., are obtained even in cases where the synthetic fiber treatment agents of the respective examples are applied to polyethylene resin, which is a polyolefin resin.

The invention claimed is:

1. A first component of a two component synthetic fiber treatment agent system, the first component comprising a phosphate compound (A), a solvent(S), and optionally a nonionic surfactant (C), wherein the first component has a mass ratio of the content of the phosphate compound (A) and the content of the nonionic surfactant (C) such that phosphate compound (A)/nonionic surfactant (C) is 95/5 to 100/0, the phosphate compound (A) contains as organic phosphate ester compounds a phosphate ester P1 represented by Formula (1) shown below, a phosphate ester P2 represented by Formula (2) shown below, and optionally a phosphate ester P3 represented by Formula (3) shown below, when in a P nucleus NMR measurement made upon performing an alkali over neutralization pretreatment, the total of P nucleus NMR integral ratios attributed to the phosphate ester P1, the phosphate ester P2, the phosphate ester P3, and an inorganic phosphate compound is taken as 100%, the P nucleus NMR integral ratio attributed to the inorganic phosphate compound is more than 0% but not more than 20%, (1)

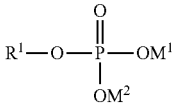

in Formula (1), $R^1$ is an alkyl group or an alkenyl group with 15 to 20 carbon atoms and $M^1$ and $M^2$ are each a hydrogen atom or potassium, (2)

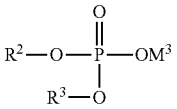

in Formula (2), $R^2$ and $R^3$ are each an alkyl group or an alkenyl group with 15 to 20 carbon atoms and $M^3$ is a hydrogen atom or potassium, (3)

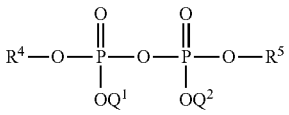

in Formula (3), $R^4$ and $R^5$ are each an alkyl group or an alkenyl group with 15 to 20 carbon atoms and $Q^1$ and $Q^2$ are each a hydrogen atom or potassium, the solvent (S) has a boiling point at atmospheric pressure of not more than 105° C., the nonionic surfactant (C) has a (poly)oxyalkylene structure in the molecule, and the first component has a nonvolatile concentration of not less than 20% by mass and not more than 60% by mass.

2. The first component of the two-component synthetic fiber treatment agent system according to claim 1, wherein when the total of P nucleus NMR integral ratios attributed to the phosphate ester P1, the phosphate ester P2, and the phosphate ester P3 is taken as 100%, the P nucleus NMR integral ratio attributed to the phosphate ester P1 is not less than 20% and not more than 90%, the P nucleus NMR integral ratio attributed to the phosphate ester P2 is not less than 10% and not more than 70%, and the P nucleus NMR integral ratio attributed to the phosphate ester P3 is not more than 40%.

3. The first component of the two-component synthetic fiber treatment agent system according to claim 1, wherein the P nucleus NMR integral ratio attributed to the inorganic phosphate compound is more than 0% but not more than 10%.

4. The first component of the two-component synthetic fiber treatment agent system according to claim 1, wherein the solvent(S) is water.

5. The first component of the two-component synthetic fiber treatment agent system according to claim 1, wherein the first component further contains a monohydric aliphatic alcohol (B) with 8 to 20 carbon atoms and the content of the monohydric aliphatic alcohol (B) in nonvolatile matter of the first component is more than 0.1% by mass but not more than 15% by mass.

6. The first component of the two-component synthetic fiber treatment agent system according to claim 1, wherein the first component has an acid value of not less than 0 mg KOH/g and not more than 20 mg KOH/g.

7. The first component of the two-component synthetic fiber treatment agent system according to claim 1, wherein the first component has a viscosity at 30° C. of not more than 40,000 mPa·s.

8. The first component of the two-component synthetic fiber treatment agent system according to claim 1, wherein the first component has a sodium ion concentration of more than 0 ppm but not more than 10,000 ppm, a calcium ion concentration of more than 0 ppm but not more than 200 ppm, and a magnesium ion concentration of more than 0 ppm but not more than 150 ppm as detected from nonvolatile matter of the first component by an ICP emission spectroscopy method.

9. The first component of the two-component synthetic fiber treatment agent system according to claim 1 that is applied to a short fiber.

10. The first component of the two-component synthetic fiber treatment agent system according to claim 1 that is applied to a polyester or a polyolefin.

11. The first component of the two-component synthetic fiber treatment agent system according to claim 1 that is applied to a polyester.

12. A synthetic fiber treatment agent arranged as a set comprising the first component according to claim 1 and a second component that contains a nonionic surfactant (E) and is separate from the first component.

13. The synthetic fiber treatment agent according to claim 12, wherein the second component further optionally contains not more than 5% by mass of an organic phosphate ester compound (D).

14. A method for preparing an aqueous liquid of a synthetic fiber treatment agent, comprising adding to water the first component according to claim 1 and a second component that contains a nonionic surfactant (E) to prepare the aqueous liquid with a nonvolatile concentration of not less than 0.01% by mass and not more than 10% by mass.

15. The method for preparing an aqueous liquid of a synthetic fiber treatment agent according to claim 14, wherein said adding includes:

a first step of adding the first component and the second component to a first water to prepare an aqueous liquid of a synthetic fiber treatment agent with a nonvolatile concentration of more than 2% by mass but not more than 10% by mass; and a second step of adding a second water to the aqueous liquid of the synthetic fiber treatment agent prepared in the first step to prepare an aqueous liquid of a synthetic fiber treatment agent with a nonvolatile concentration of not less than 0.01% by mass and not more than 10% by mass.

16. The method for preparing an aqueous liquid of a synthetic fiber treatment agent according to claim 15, wherein the first step includes adding the first component and the second component to water of 60° C. to 95° C. that is of 20% to 70% by mass of the total amount of the first water and thereafter further adding the remaining first water of not more than 40° C.

17. The method for preparing an aqueous liquid of a synthetic fiber treatment agent according to claim 15, wherein the first step includes adding the first componentto water of 60° C. to 95° C. that is of 20% to 70% by mass of the total amount of the first water, thereafter further adding the remaining first water of not more than 40° C., and thereafter further adding the secondcomponent.

18. A method for treating a synthetic fiber, comprising imparting to a synthetic fiber an aqueous liquid of a synthetic fiber treatment agent obtained by adding to water the first component according to claim 1 and a second component that contains a nonionic surfactant (E).

19. A method for manufacturing a synthetic fiber, comprising imparting to a synthetic fiber an aqueous liquid of a synthetic fiber treatment agent obtained by adding to water the first component according to claim 1 and a second component that contains a nonionic surfactant (E).

20. A method for manufacturing a short fiber, comprising imparting to a synthetic fiber an aqueous liquid of a synthetic fiber treatment agent obtained by adding to water the first component according to claim 1 and a second component that contains a nonionic surfactant (E).

21. A method for manufacturing a spun yarn, comprising imparting to a synthetic fiber an aqueous liquid of a synthetic fiber treatment agent obtained by adding to water the first component according to claim 1 and a second component that contains a nonionic surfactant (E).

22. A method for manufacturing a nonwoven fabric, comprising imparting to a synthetic fiber an aqueous liquid of a synthetic fiber treatment agent obtained by adding to water the first component according to claim 1 and a second component that contains a nonionic surfactant (E).

* * * * *